US005445341A

United States Patent [19]

Martin et al.

[11] Patent Number: 5,445,341

[45] Date of Patent: Aug. 29, 1995

[54] FLYING PASTER CORE WINDING METHOD AND APPARATUS

[75] Inventors: John R. Martin, Rockford; Roger Cederholm, Roscoe, both of Ill.; Kendall E. Schlittler, Brodhead; Ronald Wenzel, Menasha, both of Wis.

[73] Assignee: Martin Automatic, Inc., Rockford, Ill.

[21] Appl. No.: 160,586

[22] Filed: Dec. 1, 1993

Related U.S. Application Data

[63] Continuation-in-part of Ser. No. 136,609, Oct. 15, 1993, Pat. No. 5,337,969, which is a continuation of Ser. No. 935,859, Aug. 26, 1992, abandoned.

[51] Int. Cl.[6] ..... B65H 19/26; B65H 19/30

[52] U.S. Cl. ..... 242/527.3; 242/533

[58] Field of Search ..... 242/527.2, 527.3, 527.4, 242/532.3, 533, 533.1, 533.2

[56] References Cited

U.S. PATENT DOCUMENTS 3,791,603 2/1974 Lenius ..... 242/532.3

4,204,650 5/1980 Mengel ..... 242/527.4

FOREIGN PATENT DOCUMENTS 4153153 5/1992 Japan ..... 242/533

*Primary Examiner*—John M. Jillions

*Attorney, Agent, or Firm*—McAndrews, Held & Malloy, Ltd.

[57] ABSTRACT

A method and an apparatus for winding or rewinding a running web onto the center core shafts of rolls. While the running web is being wound, at a selected speed, onto a first roll which is, disposed in an operating position, a center core shaft of a new, second roll is disposed in a splicing position so that the center core shafts are side by side and adjacent to each other. A fixed drive assembly and a movable drive assembly control the speeds of the first and second rolls, respectively. The first roll has had a determined amount of web wound thereon, the running web is spliced onto the center core shaft of the second roll and thereafter is wound onto the second roll. Thereafter, the second roll is disconnected from the fixed drive assembly and is removed from the operating position. The second roll, with the running web now being wound thereon, is then moved, with the movable drive assembly, from the splicing position to the operation position. Once there, the fixed drive assembly is connected with the second roll, and the movable drive assembly is disconnected from the second roll and moved back adjacent to the splicing position, ready to be connected with the center core shaft of another roll.

14 Claims, 13 Drawing Sheets

FLYING PASTER CORE WINDING METHOD AND APPARATUS

RELATED U.S. APPLICATIONS

This is a continuation-in-part application of application Ser. No. 08/136,609 filed Oct. 15, 1993 now U.S. Pat. No. 5,337,969 that was, in turn, a continuation of application Ser. No. 07/935,859 filed Aug. 26, 1992, now abandoned.

BACKGROUND OF THE INVENTION

The present invention relates to methods and apparatus for winding or rewinding a running web of material into rolls. More particularly, the present invention relates to methods and apparatus for winding a web of material that is running from a web handling operation and that is to be wound sequentially about the center core shaft of one roll and then about the center core shaft of another roll without stopping the running web.

Various apparatus for winding or rewinding running webs into rolls are known. Basically such apparatus falls into two general classes; surface winders, and core winders. Surface winders generally have a drum that has a uniform diameter, and the roll of web material being wound is forced against the outer surface of the drum. This allows the use of smaller horsepower (for example, 4 horsepower), cost effective motors. In contrast and due to the build-up ratio, a comparable core winder might require a 40 horsepower motor. The difference in motor sizes results in a significant difference in the costs for the winders. Largely because of this cost difference, surface winders have been generally preferred by cost conscious purchasers.

Surface winders have, however, had long recognized disadvantages. For instance, they cannot be used with web materials whose surfaces cannot or should not be touched during the winding operation. Additionally, satisfactory tapered tension control is more difficult, and thus more expensive, to achieve in surface winders as compared to core winders. Those working in the art have long sought a winder, without the disadvantages of surface winders, that would be more cost competitive with surface winders.

Conventional core winders have other disadvantages, besides cost, vis-a-vis surface winders. Typical turret-type core winders tend to be large and require space to accommodate the swinging of their roll bearing arms through the approximately 180° arcs. Additionally, turret type core winders require another motor to affect the movement of their roll bearing arms, as well as mechanisms to attempt to assure the proper level and angular alignment of the rolls after such movement, particular where high quality rolls are being wound. This adds to the cost of the core winders. Again, those working in the art have also sought a core winder that would be cost competitive with surface winders and that would not have these aforementioned disadvantages.

SUMMARY OF THE INVENTION

In principal aspect, the present invention is directed to an improved flying paster core winding method and apparatus for winding or rewinding a running web of material sequentially onto center core shafts of a plurality of rolls. The present invention overcomes the aforementioned disadvantages associated with the prior core winders while being quite cost competitive with conventional surface winders. The present invention may be embodied in a flying paster core winder that does not employ a turret concept, and accordingly, does not need the space required by conventional turret-type core winders for similar sized rolls. Flying paster core winders of the present invention are thus less expensive to manufacture, vis-a-vis conventional turret-type core winders, because they do not include the turret and associated structures.

Instead of having to be pivoted through a major arc, the rolls in the flying paster core winders of the present invention are only moved approximately 30 inches, along a straight, horizontal path, between a splicing position and an operating or web winding position. Then, after a determined amount of web has been wound onto a roll, the roll is again moved a similar distance, again along a substantially straight path, to a position where the roll may be easily off-loaded from the core winder.

Further and instead of using a large horsepower motor, like conventional core winders, the improved flying paster core winders of the present invention utilize two, relatively smaller horsepower motors (for example and with reference to the exemplary motors noted above, two 7 horsepower motors). The savings in motor costs enables the flying paster core winders of the present invention to compete, on a cost basis, favorably with conventional surface winders without having the aforementioned disadvantages of such surface winders.

Accordingly, the primary object of the present invention is to provide an improved flying paster core winding method and apparatus for winding or rewinding a running web where the running web is initially being wound onto the center core shaft of a first roll; where after the first roll has had a determined amount of web wound thereon, the running web is spliced onto and thereafter wound about the center core shaft of a second roll; and where the running web is run at a preselected speed while the running web is being wound about or into the first roll, while the running web is being spliced and while the running web is being wound about or into the second roll.

Another object of the present invention is to provide an improved method and apparatus, as described above, where the first roll is driven, by a fixed drive assembly, while the first roll is disposed in an operating position so that the running web runs at the preselected speed; where the central core shaft of the second roll is disposed in a splicing position which is adjacent to the first roll in its operating position; where the running web is run so that it passes adjacent to the center core shaft of the second roll before it is wound onto the first roll; where the center core shaft of the second roll is driven, while in its splicing position, by a movable drive assembly so that the rotational speed of the center core shaft of the second roll matches the preselected speed of the running web; where an adjacent portion of the running web is pressed into surface to surface contact with the outer peripheral surface of the center core shaft of the second roll such that that portion will adhere to the outer peripheral surface of the center core shaft of the second roll; where the second web is then cut, downstream of the adjacent portion of the running web, so that the running web will then begin to wind about the center core shaft of the second roll; and where the first roll is disconnected from the fixed drive assembly and moved from the operating position; and where the second roll and the movable drive assembly is then moved, along a substantially straight path, from the splicing position to the operating position.

Still another object of the present invention is to provide an improved method and apparatus, as described, where the first and second rolls, in their operating and splicing position, respectively, are adjacent to each other and are disposed side by side; and where the second roll is generally moved horizontally from the splicing position to the operating position.

A further object of the present invention is to provide an improved method and apparatus, as described, where the fixed drive assembly is connected with the center core shaft of the second roll after the second roll has been moved from the splicing position to the operating position; and where the first roll is moved from the operating position, and after being moved, may be easily lifted out of the core winder apparatus of the present invention by means incorporated in the apparatus.

A still further object of the present invention is to provide an improved method and apparatus, as described, where the movable drive assembly is disconnected from the center core shaft of the second roll after the fixed drive assembly has been connected with the center core shaft of the second roll; and where the movable drive assembly is then moved back to a position where it may be connected with another roll's center core shaft that is thereafter disposed at the splicing position.

These and other objects, advantages and benefits of the present invention will become apparent from the following description of the preferred embodiment of the invention as illustrated in the drawings next described.

DESCRIPTION OF THE PREFERRED EMBODIMENT

Figure 1:
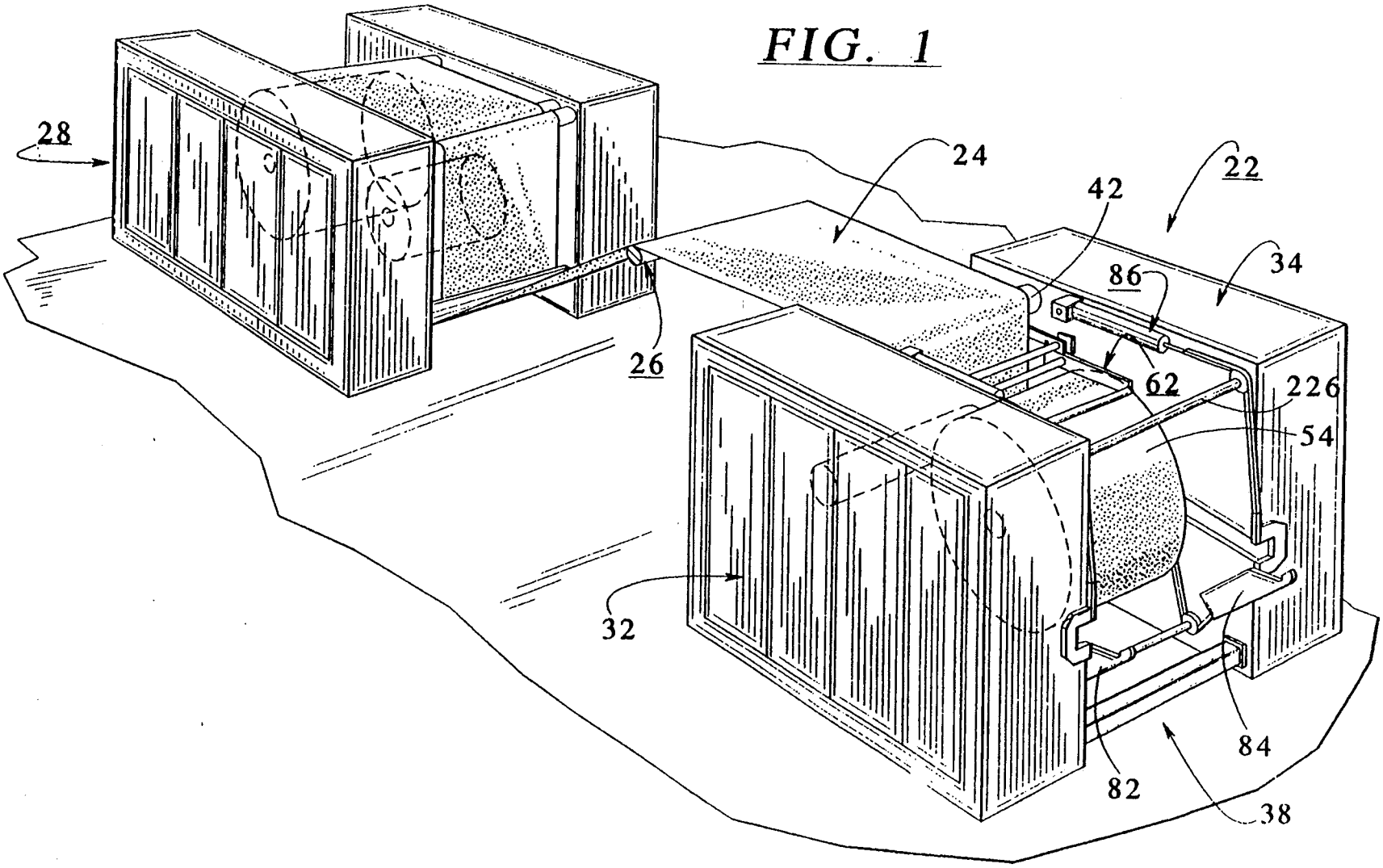
FIG. 1 is a perspective view showing a flying paster unwinder, such as disclosed in co-pending application Ser. No. 08/136,609, on the left, and a flying paster core winder of the present invention on the right.

Referring now to FIG. 1, a preferred embodiment of the flying paster core winder of the present invention is generally shown at 22. As noted, the primary function of the core winder 22 is to wind or rewind a running web 24, which may comprise a variety of different materials, into rolls. Prior to coming to the core winder 22, the web 24 will usually have passed through web handling operation, such as, for example, a printing press. (In FIG. 1, such a web handling operation is represented by a roller 26.)

Generally the web 24 will have been unwound from rolls by an unwinding apparatus, such as generally shown at 28 in FIG. 1, before it passes through the web handling operation. This apparatus 28 may be the flying paster unwind apparatus disclosed in co-pending U.S. patent application (hereinafter the "Application") Ser. No. 08/136,609, filed Oct. 15, 1993. The disclosure of this Application is incorporated herein by reference thereto.

Figure 2:
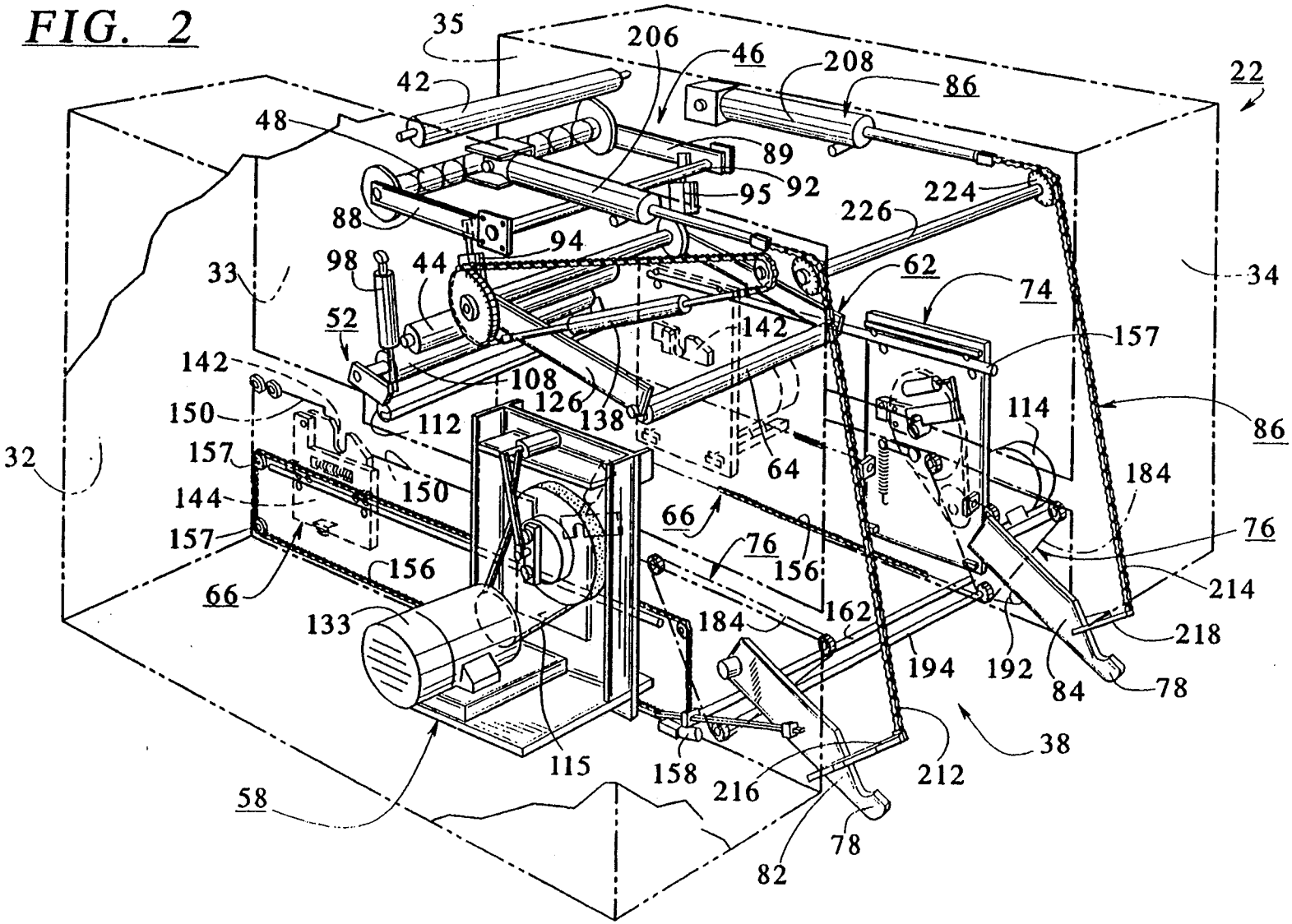
FIG. 2 is a perspective, operator side, side view of the flying paster core winder apparatus of the present invention with its two side housings shown in phantom lines.

As best illustrated in FIGS. 1–2, the core winder 22 includes an operator side housing 32 and a drive or gear side housing 34. Each of these housings 32 and 34 is a generally rectangular structure, that has a generally open interior, that is constructed from heavy steel sheets, and that supports and houses various components of the core winder 22.

The housings 32 and 34 have spaced apart, facing side walls 33 and 35 that are generally parallel to each other. These walls are spaced apart a predetermined distance that is greater than the width of the running web 24. Rolls of the web 24, which are being wound on the core winder 22, are adapted to be positioned between these facing side walls 33 and 35 while the running web is running and rolls of the web are being wound. The running web 24 enters the core winder 22, or more particularly, the space between the housings 32 and 34, at one end 36 of that space (that is, the end facing the flying paster unwinding apparatus 28 as shown in FIG. 1) and completed, wound rolls exit from the core winder 22 from a roll exit end 38.

Figure 3:
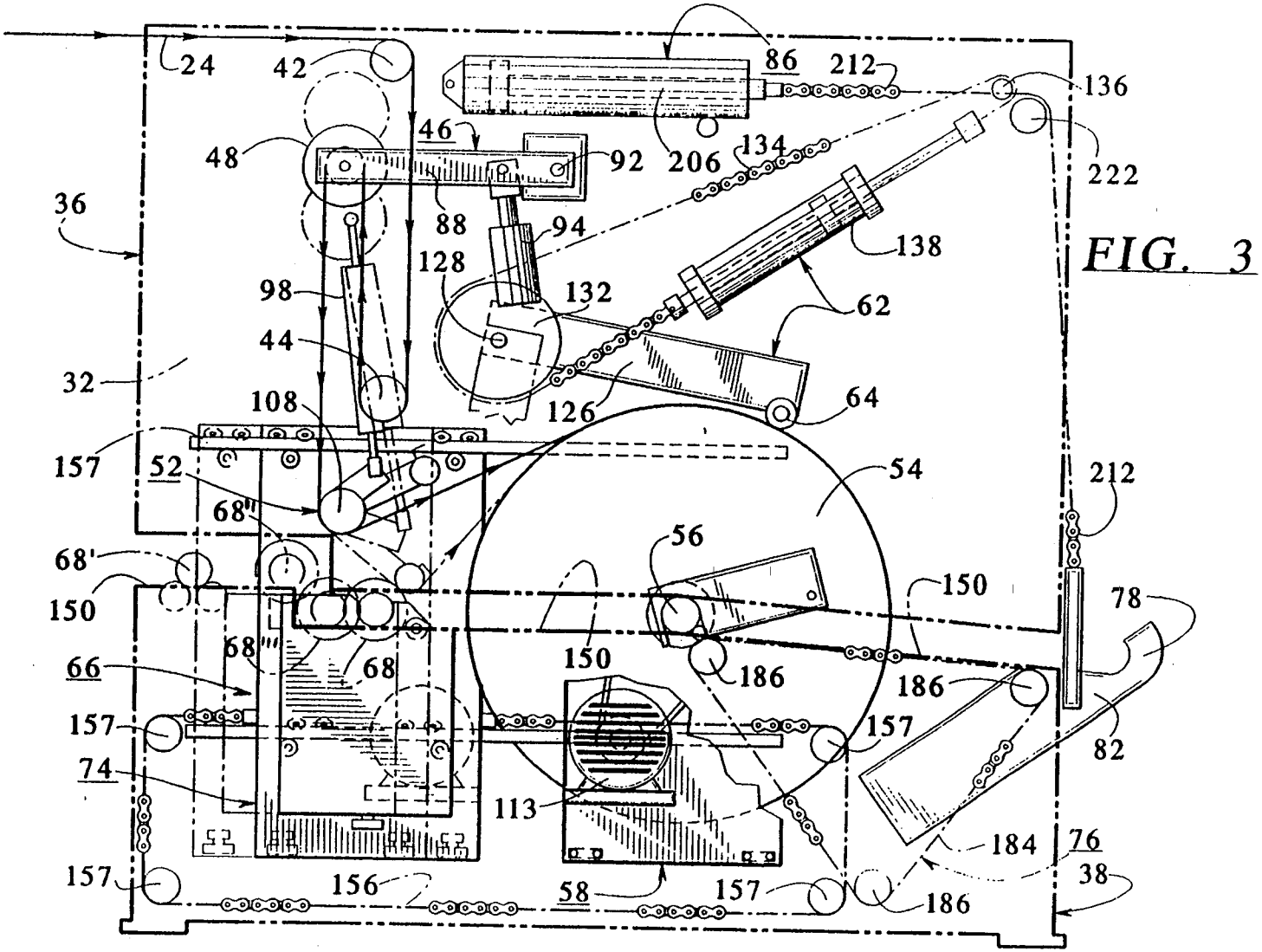
FIG. 3 is an operator side, side view of the flying paster core winder of the present invention.

Referring now to FIGS. 2 and 3, the web 24 enters the web entry end 36 and passes around a first turning roller 42 which directs the web generally downwardly. The web 24 next passes about a second turning roller 44 that again directs the web generally upwardly. The ends of the rollers 42 and 44 are mounted for rotation on the housings 32 and 34.

The running web 24 then passes about a conventional, single roller pivoting dancer assembly 46, or more specifically, about the roller 48 of that assembly.

Exiting from the dancer assembly 46, the running web 24 next passes around or about a web splice assembly 52. After passing around the assembly 52, the web 24 is wound on a steel center core shaft. (In practice, a center core shaft will have a fiberboard, tubular core placed over them by the core winder operator before the shaft is put into the winder 22. Additionally, double sided adhesive tape will be applied by the operator to the exterior surface of the fiberboard core to facilitate splicing the web 24 onto the fiberboard core or onto the center core shaft.) In FIG. 3, the web 24 is shown as being wound into a roll 54 that has a center core shaft 56 and that, as shown, is disposed in the operating position in the core winder 22. Referring again to FIG. 3, the operator side end of the center core shaft 56 is connected with a fixed drive assembly 58 that rotates the shaft 56, and thus the roll 54, so as to pull the web 24 and wind it about the shaft 56.

A conventional lay-on roller assembly 62 includes a roller 64. This roller is adapted to lay across and presses against the web 24, in a conventional manner, as it is wound about the roll 54.

A core carrier assembly 66 is adapted to receive and carry the ends of a second center core shaft 68. The assembly 66 includes parts positioned adjacent to both of the facing side walls 33 and 35 of the housings 32 and 34 and is adapted to receive the ends of the center core shaft 68 that has been introduced into the core winder 22 through the web entry end 36. Once the ends of the center core shaft 68 are received by the core carrier assembly 66, the core carrier assembly, and the shaft 68, move forward slightly (that is, toward the end 38) so that the shaft 68 is positioned in the splice position. (The phantom line illustrations in FIG. 3 of the shaft 68 at 68', 68'' and 68''' illustrate the shaft as it is introduced into the winder 22, and moved to the splicing position—where the shaft 68 is shown in solid lines in FIG. 3.) When the shaft 68 is in the splice position, the drive side end of the center core shaft 68 is connected with a movable drive assembly 74.

After a predetermined amount of web 24 has been wound onto the roll 54, the movable drive assembly 74 causes the shaft 68, in the splice position, to rotate so that the surface speed of the shaft matches that of the running web 24. The web splice assembly 52 is disposed, when ready for a splice, so that a portion of the running web passes closely adjacent to the shaft 68 as the web runs into the roll 54. The assembly 52 is then actuated so as to splice a portion of the running web 24 onto the center core shaft 68. As noted and to facilitate the splice, the outer or exterior surface of the fiberboard core, which has been placed over the shaft 68, has had double-sided sticky adhesive tape applied to it so that the portion of the running web will adhere to that core at the time of splicing. Thereafter the web 24 is cut immediately downstream of the spliced portion so that the web 24 no longer winds onto the roll 54, but rather begins to wind about the shaft 68.

Figure 5:
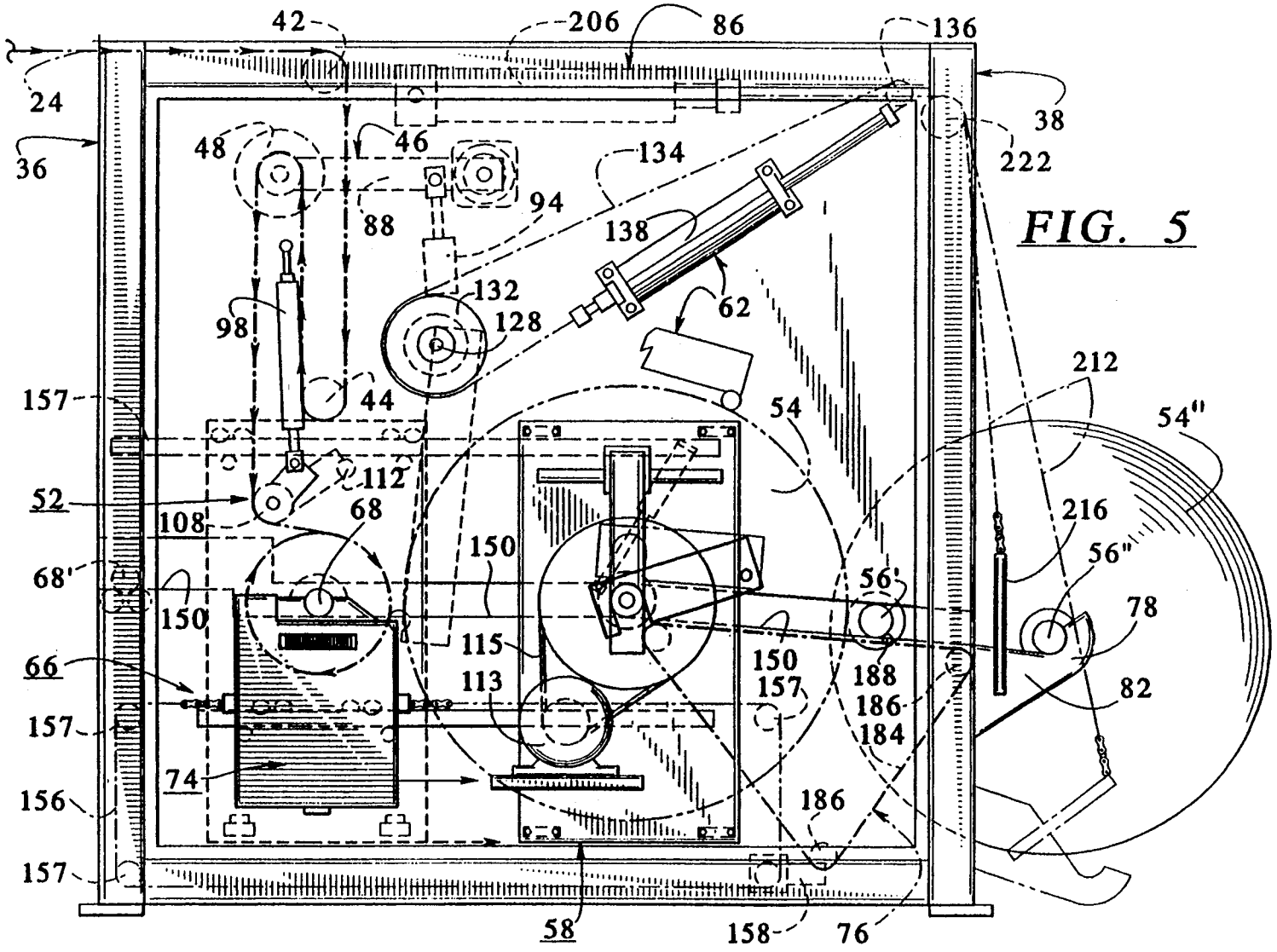
FIG. 5 is an operator side, side view of the flying paster core winder of the present invention illustrating the movement of a roll as it moves from the operating position.
Figure 6:
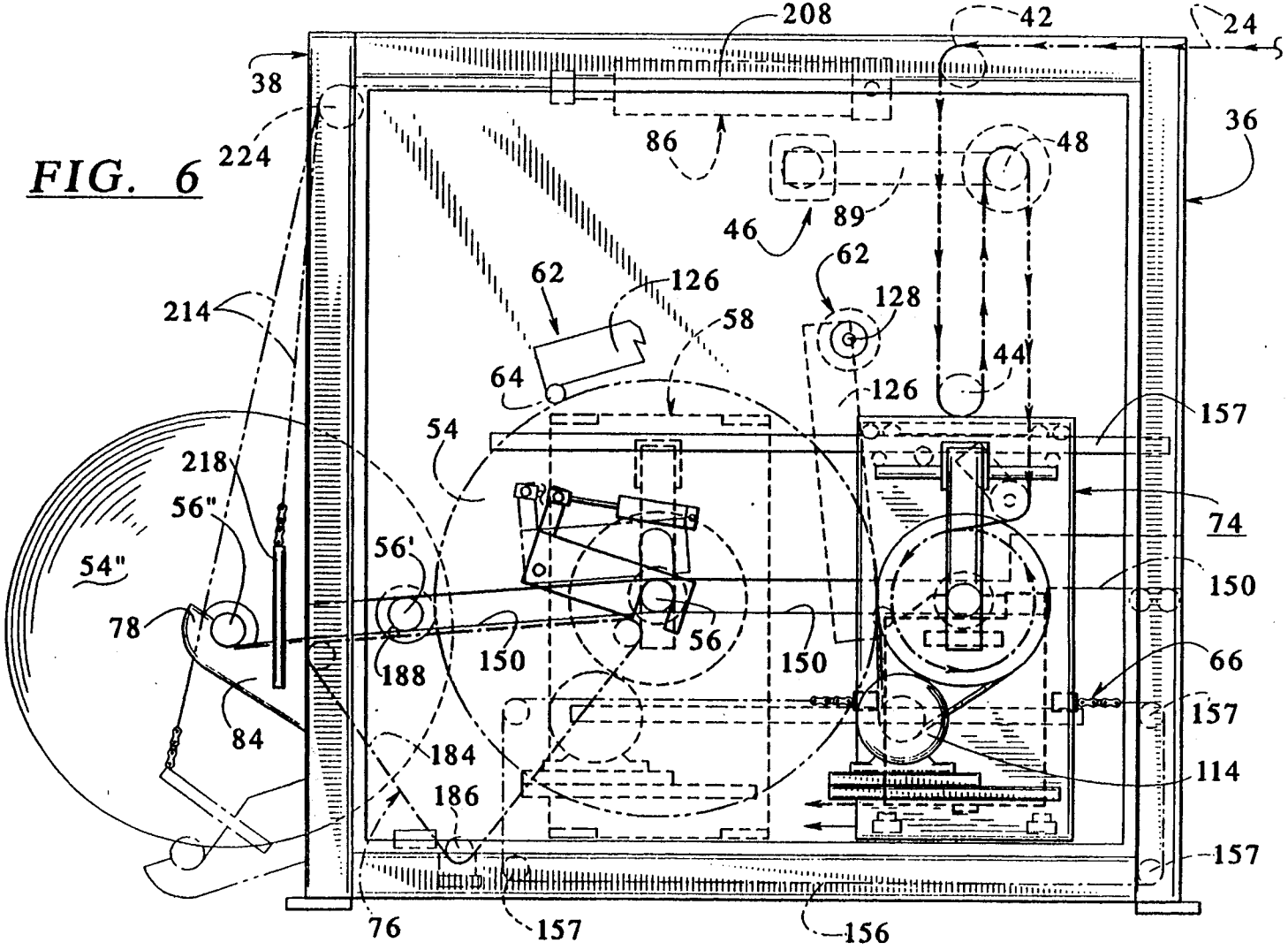
FIG. 6 is a drive or gear side view of the flying paster core winder of the present invention corresponding to the FIG. 5 view.

After a splice has been made and the web cut, the fixed drive assembly 58 permits the rotation of the web roll 54 to stop. The operator side end of the center core shaft 56 is then disconnected from the fixed drive assembly 58. A core dump chain assembly 76 is used to transport the center core shaft 56, and thus the roll 54, from the operating position toward the roll exit end 38. When the roll 54 reaches the end 38, the ends of the center core shaft 56 are received in the crooked or hooked ends 78 of a pair of roll unload arms 82 and 84. These hooked ends 78 are adapted to catch and hold the ends of the center core shaft 56, as best shown in FIGS. 5 and 6. When the arms 82 and 84 are disposed in their upper positions, the roll 54 will be suspended above the floor. A roll unload assembly 86, which includes the arms 82 and 84, may then be actuated by the core winder operator to lower the arms 82 and 84 to their lower position so that the roll 54 may be easily removed from the winder 22 and stored.

After the roll 54 has been moved from the operating position and is supported by the roll unload arms 82 and 84 (or has been removed from the core winder 22 completely), the center core shaft 68, with the running web 24 being wound thereon, is moved, along a predetermined path, from the splicing position (as shown in FIGS. 5 and 6) to the operating position by the core carrier assembly 66. The path of movement is straight, horizontal and relatively short, for example, may be about thirty inches. As noted, the movable drive assembly 74 moves with the assembly 66 and the shaft 68, and continues to rotate the shaft 68 during this movement and after the shaft 68 reaches the operating position.

After the center core shaft 68 and the movable drive assembly 74 have been moved to the operating position, the fixed drive assembly 58 is connected with the operator side end of the center core shaft 68 and also begins to drive the shaft 68. Thereafter, the movable drive assembly 74 is disconnected from the drive side end of the center core shaft 68. The carrier assembly 66 is again actuated and moves the movable drive assembly 74 back along the path to a position adjacent to the splicing position so that when another center core shaft is placed into the core winder 22, the drive side end of that center core shaft may be connected with the assembly 74.

The fixed drive assembly 58 continues, thereafter, to drive the center core shaft 68, and the roll of web material that is being wound thereon, until again a predetermined amount of web has been wound onto the roll. While this winding occurs, and as noted, still another center core shaft may be introduced into the core winder 22 so as to be positioned for another splice and to permit the above described winding operation to be repeated.

Turning now to the various assemblies and components of the flying paster core winder 22, these assemblies and components are structurally and functionally similar to the corresponding assemblies and components described in the Application except as noted. In this regard, the single roller pivoting dancer assembly 46 is similar to the dancer assembly 102 in the Application. The ends of the roller 48 are supported for rotation between the distal ends of a pair of spaced apart arms 88 and 89. The other ends of the arms 88 and 89 are connected to a cross rod 92 so that the arms may pivot about the longitudinal axis of that cross rod. The ends of the rod 92 are supported by the housings 32 and 34. The one ends of two conventional double-acting fluid cylinders 94 and 95 are connected with the arms 88 and 89, between the ends of the arms, so that actuation of the cylinders will pivot the arms about the longitudinal axis of the rod 92. The other ends of the cylinders 94 and 95 are connected with the housings 32 and 34, respectively.

Figure 4:
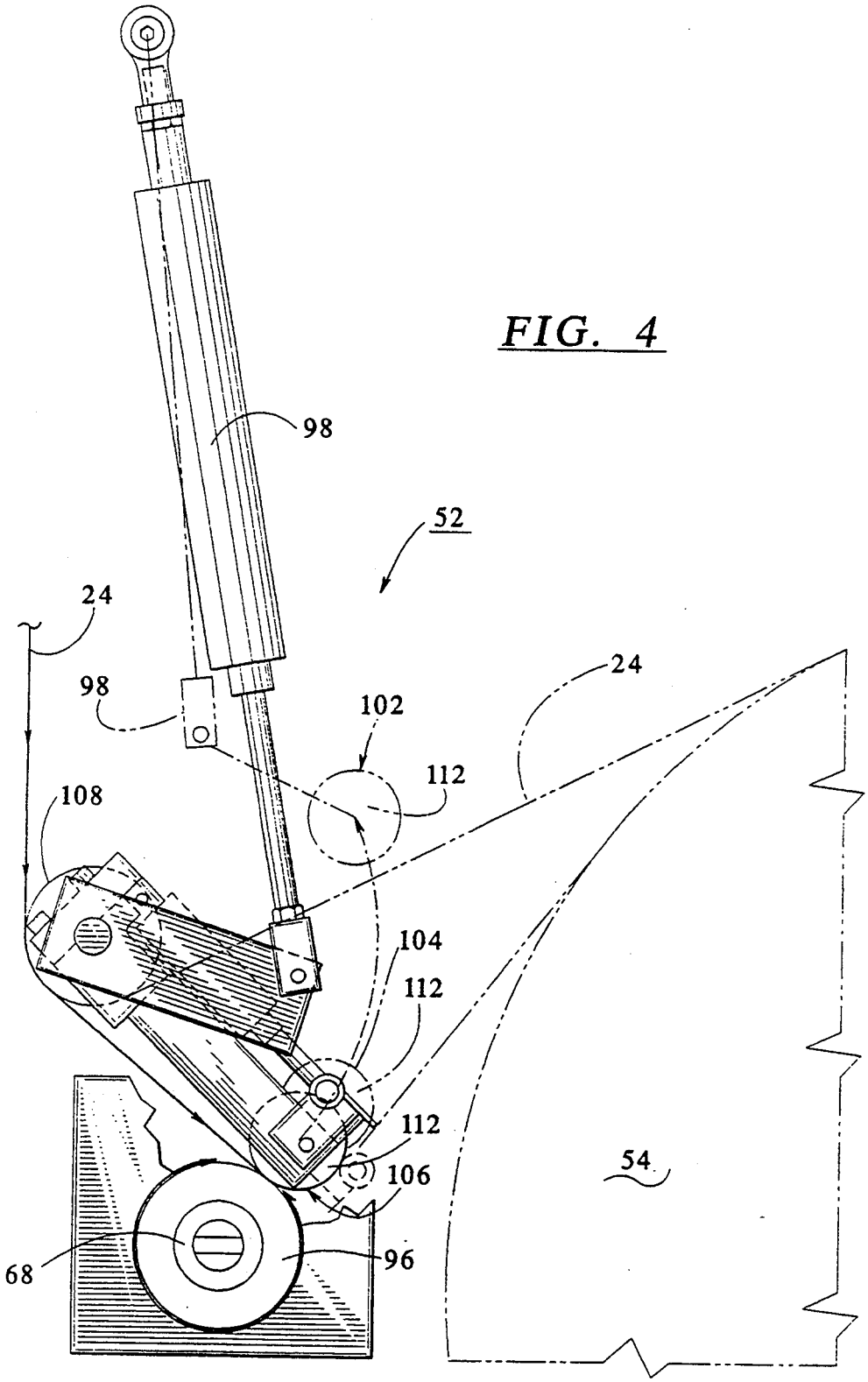
FIG. 4 is an operator side, side view of the running web splice assembly of the present invention illustrating the assembly in its normal web running, its splice reparation and its splicing positions.

The structure and function of the web splice assembly 52 is generally like the Application's splice assembly 48, except as shown in FIG. 4, the assembly 52 is not moved up to a generally horizontal position when the web 24 is normally running onto a roll in the operating position. A fluid cylinder 98, which corresponds to the Application cylinder 88, moves the assembly 52 between an upper, normal web running position 102, a splice preparation position 104 and a splice position 106, all of which positions are shown in FIG. 4. In all positions, the web 24 passes about a roller 108 supported by the assembly 52. In the latter two positions 104 and 106, the web also passes about a roller 112 that is also supported by the assembly 52. After the assembly 52 is moved to its splice position, a portion of the running web 24 is pressed, as noted above, against the outer surface of a fiberboard core (which the core winder operator has placed over the center core shaft 63 prior to putting the shaft in the winder 22) and thus against the double-sided adhesive tape wrapped about this fiberboard core. The web 24 is then cut, downstream from that portion, as is described in the Application.

Figure 9:
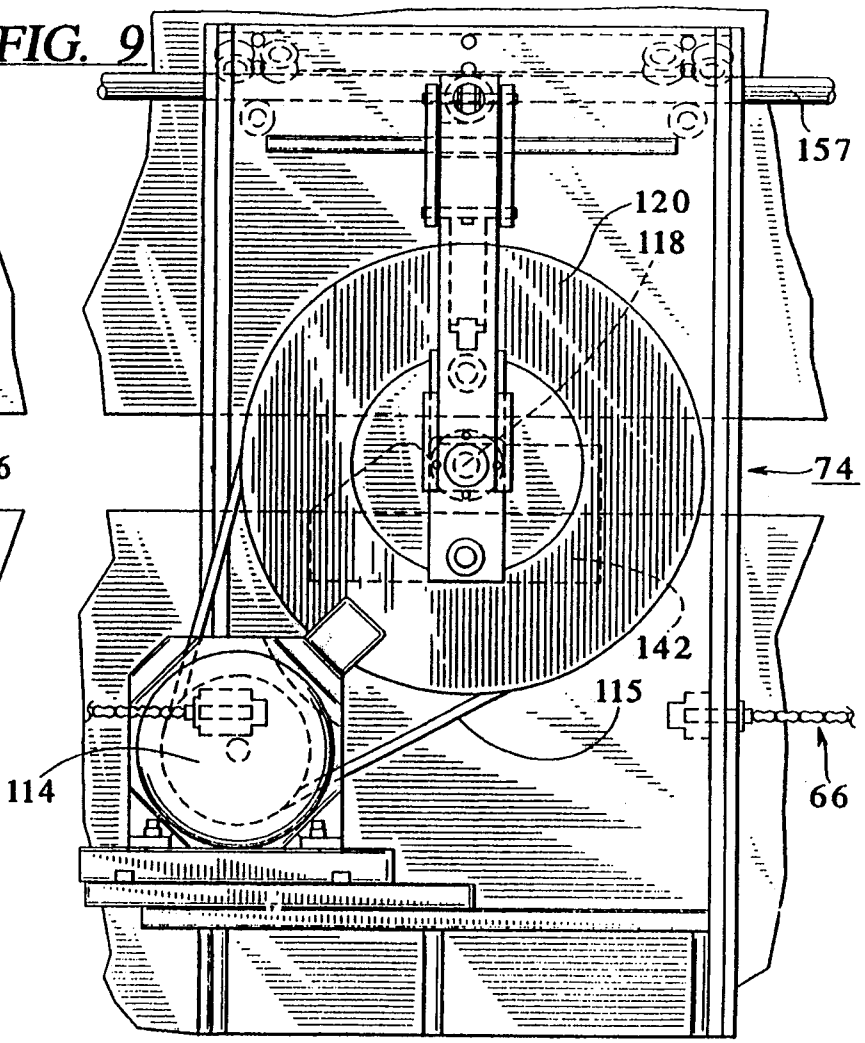
FIG. 9 is a drive or gear side, front view of the moving drive assembly for driving the center core shaft of a roll.
Figure 8:
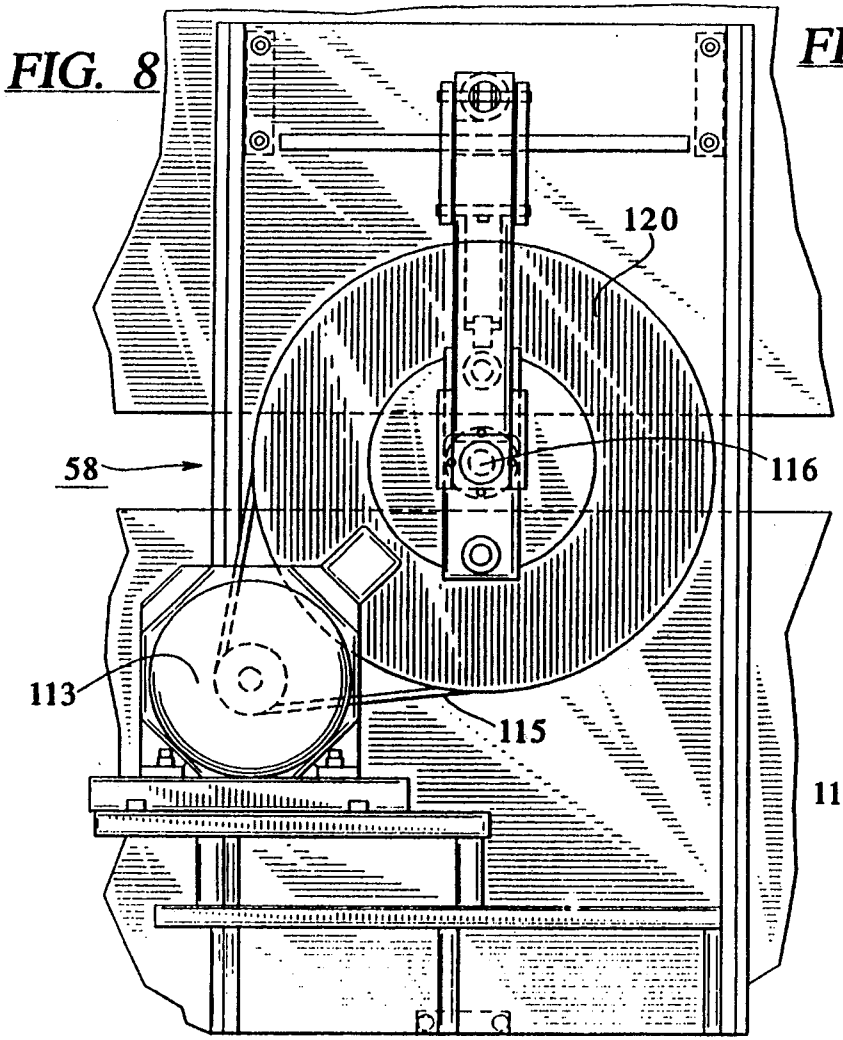
FIG. 8 is an operator side, front view of the fixed drive assembly for driving the center core shaft of a roll.

The fixed drive assembly 58 and the movable drive assembly 74 are structurally and functionally similar to the Application's assemblies 44 and 42, respectively, except that the assemblies 58 and 74 include regenerative drive motors 113 and 114. These regenerative drive motors 113 and 114 may either be a D.C. drive system or an A.C. vector system. They need only be relatively small horsepower motors (for example, seven horsepower) because of the unique structure and method of operation of the core winder 22. As best illustrated in FIGS. 8 and 9, polychain "KEVLAR" brand belts 115 are utilized to interconnect the output shafts of the motors 113 and 114 with the longitudinally movable spindles 116 and 118, respectively, via drive pulleys 120. The distal ends 122 and 124 of the spindles 116 and 118, respectively, are adapted to be connected with and be disconnected from the operators side and the drive side ends, respectively, of the center core shaft 56 and 68 as described in the Application.

Referring to FIGS. 2, 3, 5 and 6, the lay-on assembly 62 includes a pair of arms 126 whose distal ends journal the ends of the conventional lay-on roller 64. This roller 64 is adapted to lay-on the most recently laid layer or turn of the web 24 being wound into a roll, whether the roll being wound is in the splice position or in the operating position. The other ends of the arms 126 are connected with a cross rod 128 whose ends are supported by the housings 32 and 34. The operator's side end of that rod 128 includes a sprocket 132, and this sprocket cooperates with a chain 134. The chain 134 extends around a second sprocket 136 that is also mounted for rotation on the housing 32. The opposite ends of the chain 134 are connected with the opposite ends of a conventional double-acting fluid cylinder 138 that is also mounted on the housing 32. Actuation of the cylinder 138 causes the roller 64 to pivot about the longitudinal axis of the cross rod 128.

Also referring to FIGS. 2, 3, 5 and 6, the ends of the center core shaft 66 move along a pair of parallel move rails 150 that are attached to the housings 32 and 34. These rails 150 are horizontally disposed between the splice and operating positions and are inclined downwardly from the operating position to the roll exit end 38. Between the end 36 and a point slightly or just upstream from the splice position, the rails 150 are disposed in a horizontal plane spaced slightly above the horizontal plane of the rails 150 disposed between the splice and operating positions.

The core carrier assembly 66 is generally similar, in structure and function, to the Application assembly 104. In assembly 66, two carrier keepers 142 carry the ends of the shaft 68 from the splicing position to the operating position. The carrier keepers 142 are structurally and functionally identical except that the carrier keeper 142 on the drive side moves with the movable drive assembly 74.

Figure 10:
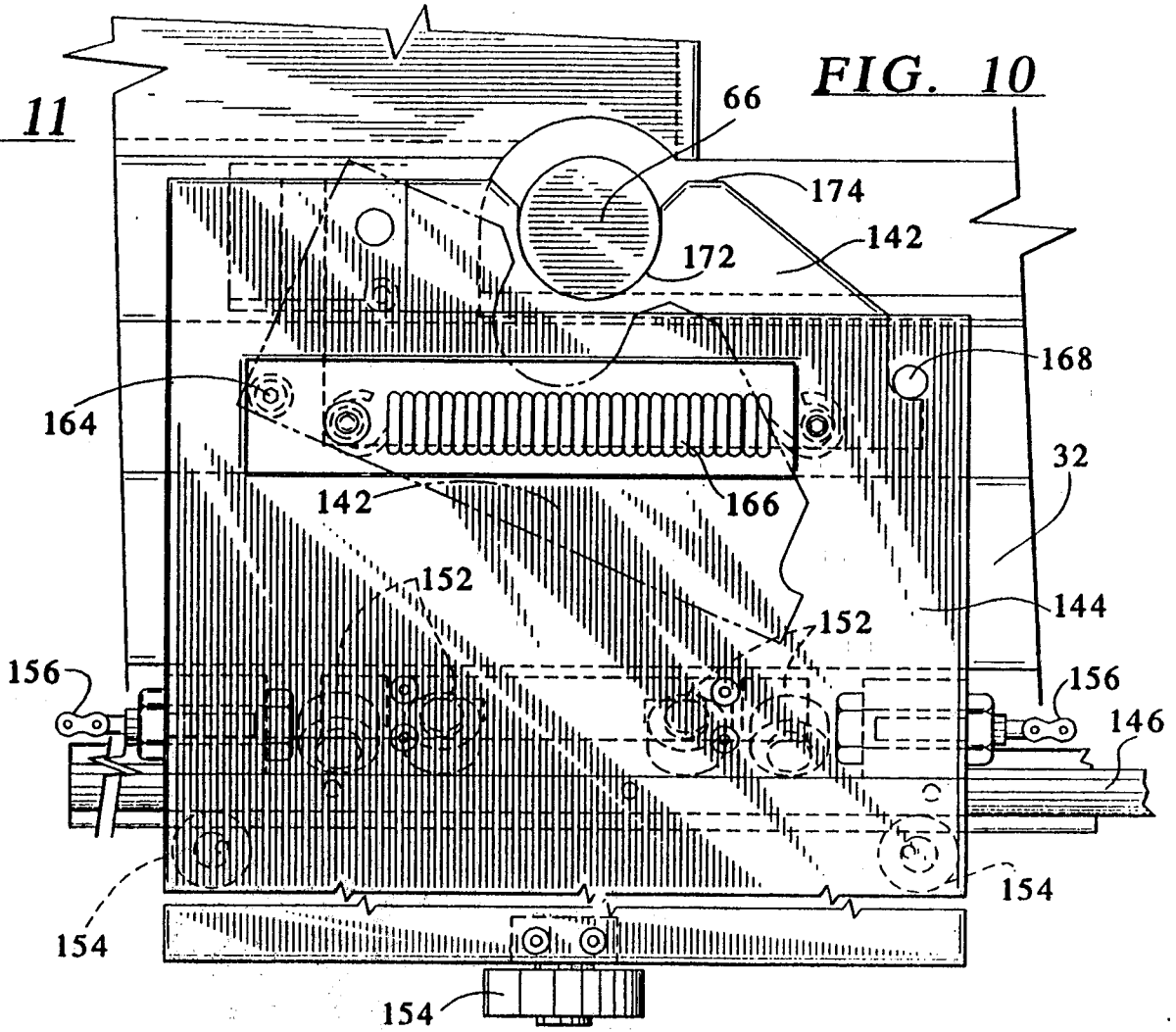
FIG. 10 is a partial, drive or gear side, front view of the moving core retainer assembly.
Figure 11:
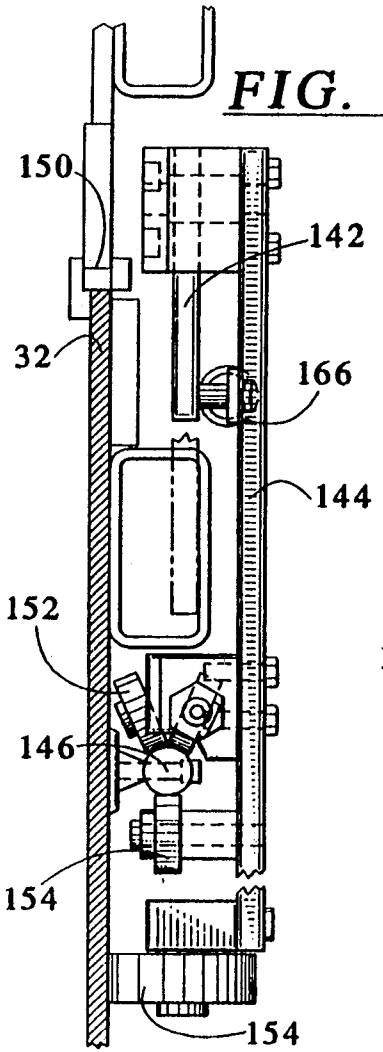
FIG. 11 is an end view of the assembly shown in FIG. 10.

As best shown in FIGS. 10–11, the carrier keeper 142 on the operator's side is mounted on a carrier member 144 that, in turn, is supported on and is movable along a horizontally disposed carrier rail 146 attached to the housing 32. A plurality of mounting rollers 152 are attached to the plate 144 and ride on the rail 146. A plurality of guide rollers 154 guide the plate 144 as it moves along the rails 146. The ends of a drive chain 156 are connected with the opposite ends of the plate 144. The chain 156 passes about a plurality of sprockets 157 and is driven by a relative small conventional electric motor 158.

A similar drive chain 156 is connected with the assembly 74, which includes the carrier keeper 142 and member 144 that carries the drive side end of the shaft 68. (The assembly 74 moves along a carrier rail 150 by means of a plurality of mounting and guide rollers.) The motor 158 drives both chains 156 by means of a cross-rod 162 (as best seen in FIG. 2) that extends between the housings 32 and 34 and that synchronizes the movement of the chains. Movements of the drive chains 156 moves both carrier keepers 142, and on the drive side, also moves the movable drive assembly 74.

Referring again to FIGS. 10 and 11, the end adjacent to the roll entry end 32 of each carrier keeper 142 is pivotally mounted, by a pivot pin 164, to the plate 144. A generally horizontally disposed coil spring 166 is connected between the plate 144, at its left end (as seen in FIG. 10) and the keeper 142, on its right hand end. The spring 166 exerts a counter-clockwise bias on the carrier keeper 142 about the pin 164. A limit pin 168, mounted on the plate 144, limits the counter-clockwise pivoting of the carrier keeper 142 so that the carrier keeper is normally horizontally disposed. The upper surface of the carrier keeper 142 includes an upwardly facing notch 172 and has a trailing or upstream shoulder 174 as shown in FIG. 10. The notch 172 is adapted to "capture" the adjacent shaft end and prevent it from moving, relative to the keeper, along the move rail 150.

As noted above, when preparing for a splice, the core winder operator places a fiberboard core about the center core shaft, such as the shaft 68, and lays the ends of the shaft 68 on the move rail 150 adjacent to the end 36. He or she then slides or rolls the shaft along the move rail 150 until the ends of the shaft drop down into the notches 172 in the carrier keepers 142. The carrier keepers 142, and the shaft 68, are then moved forward (that is, toward the end 38) until the shaft 684, is in the splice position, as illustrated in the solid line position of the shaft 68 in FIGS. 5 and 6.

After a splice has been made, the motor 158 is actuated, and the carrier keepers 142, and thus the shaft 68 (as well as the movable drive assembly 74), are moved from the splice position to the operating position. When the shaft 68 reaches the operating position, core retaining plates 175, one for each end of the shafts 68, are actuated to retain the ends of the shaft 68 by "capturing" the shaft ends in retaining notches 176 formed in the lower edges of the plates 175.

Figure 12:
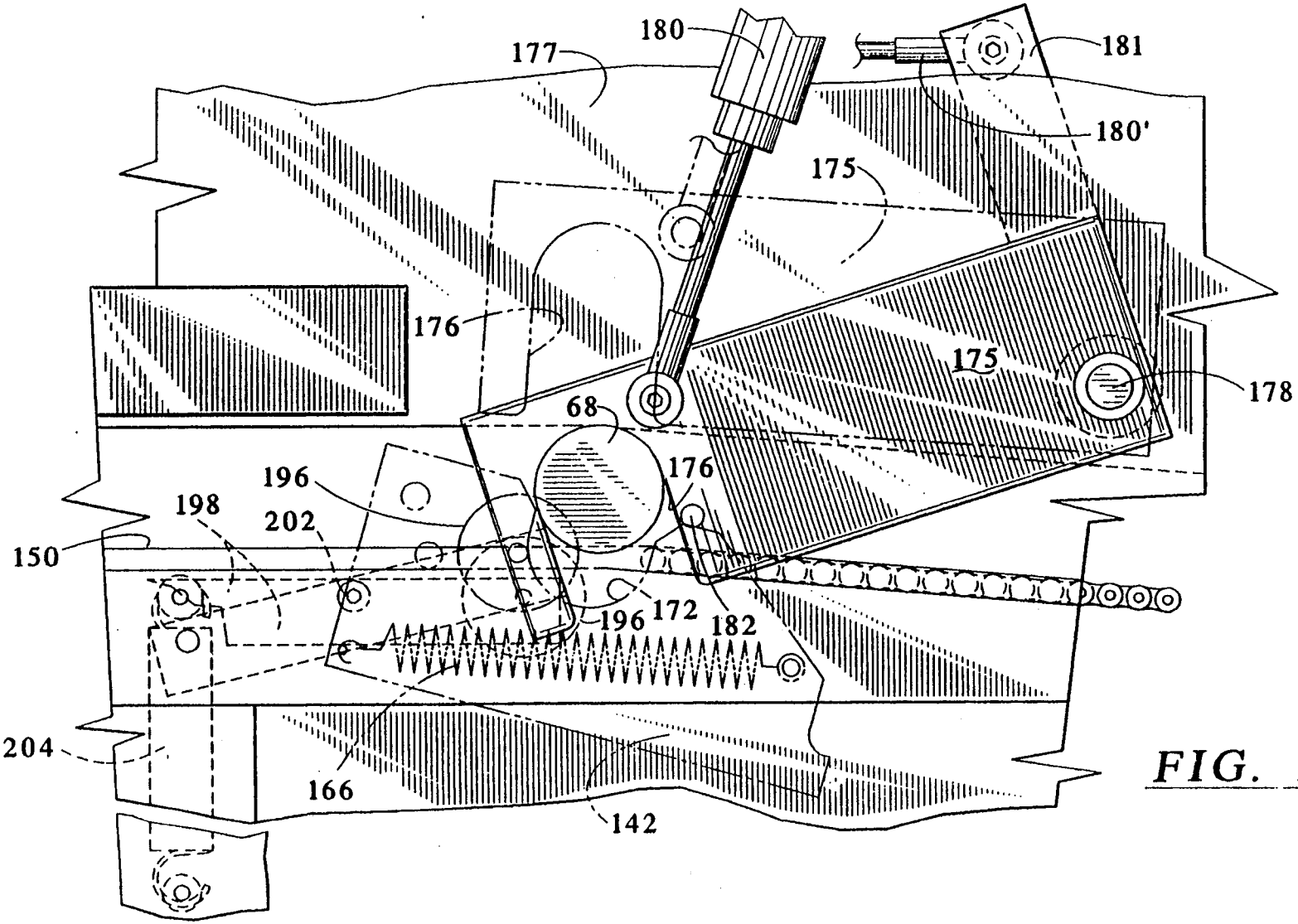
FIG. 12 is a partial, drive or gear side, front view of the fixed core retainer assembly showing the fixed core retainer plate securing the operator side end of the center core shaft while contacting the core moving retainer plate.

As best shown in FIG. 12, the retaining plate 175 on the operator side (the retaining plate 175 on the drive side being identical in structure and function except as noted) is pivotally mounted, by a pin 178, on a fixed plate 177, which is, in turn, attached to the housing 32. The plate 175 may pivot about the pin 178 between an upper position where notch 176 does not "capture" the shaft end, and a lower, shaft retaining position where the notch 176 "captures" or overlies the end of the shaft 68 and holds it against movement along the move rail 150. A double-acting fluid cylinder 180 is connected with the plate 175 and moves the plate 175 between these two positions. (The cylinder 180' on the drive side is connected with the retaining plate 175 on that side by means of a member 181, also shown in FIG. 12; whereas, on the operator's side, the cylinder 180 is directly connected with the plate 175.)

Each of the retaining plates 175 includes a pin 182 that is adjacent to the upstream edge of the notch 176 and that is adapted to contact the shoulder 174 of its associated carrier keeper 142 when the plate 175 is moved to its lower retaining position. Such contact causes the carrier keepers 142 to pivot or move downwardly, about their pins 164 and against the bias of the springs 166, so that their notches no longer "capture" the shaft 66. This movement permits the carrier keepers 142—along with the movable drive assembly 74—to be moved back to the splice position by the assembly 66.

The core dump chain assembly 76 includes a pair of endless chains 184, one mounted for rotation on the housing 32 and the other mounted for rotation on the housing 34. Each of the chains 184 passes about a plurality of sprockets 186 that are mounted on their respective housings and that define a generally, triangularly shaped path of movement for the chain. The upper portion of this triangular path generally parallels the inclined portion of the move rail 150 and extends from the operating position to the end 38. A plurality of core dump tabs 188 are carried, at spaced intervals, by the chains 184, and are adapted to cooperate with the shaft (such as the shaft 56) as the shaft 56, and the roll 54, move down the inclined move rail 150 from the operating position. A small conventional electric motor 192 is used to drive the chains 184. A cross rod 194 extends between the housings 32 and 34 and synchronizes the movement of the chains 184.

Figure 7:
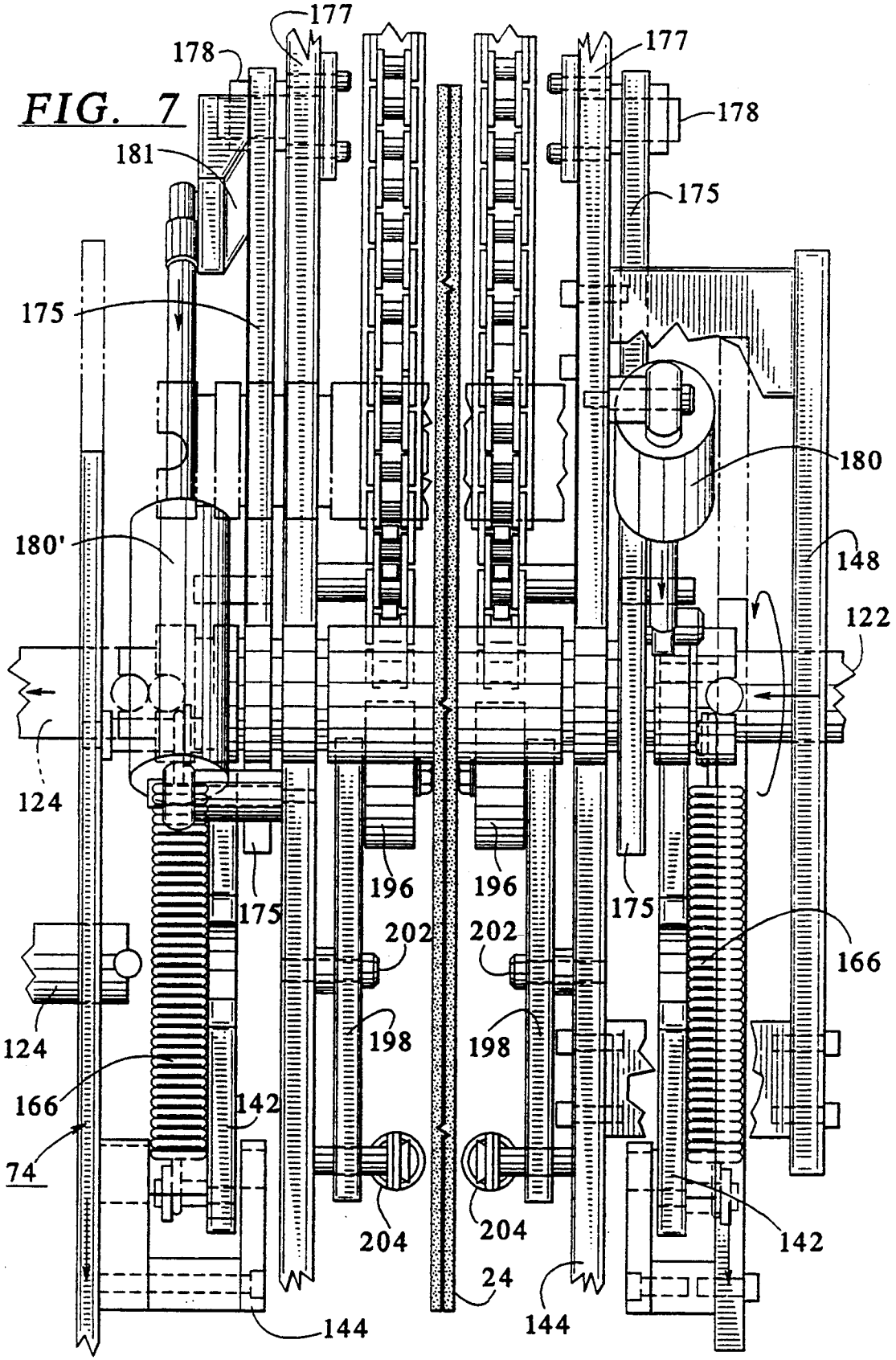
FIG. 7 is a partial top plan view illustrating the means for connecting the center core shafts to the moving and fixed drive assemblies.
Figure 13:
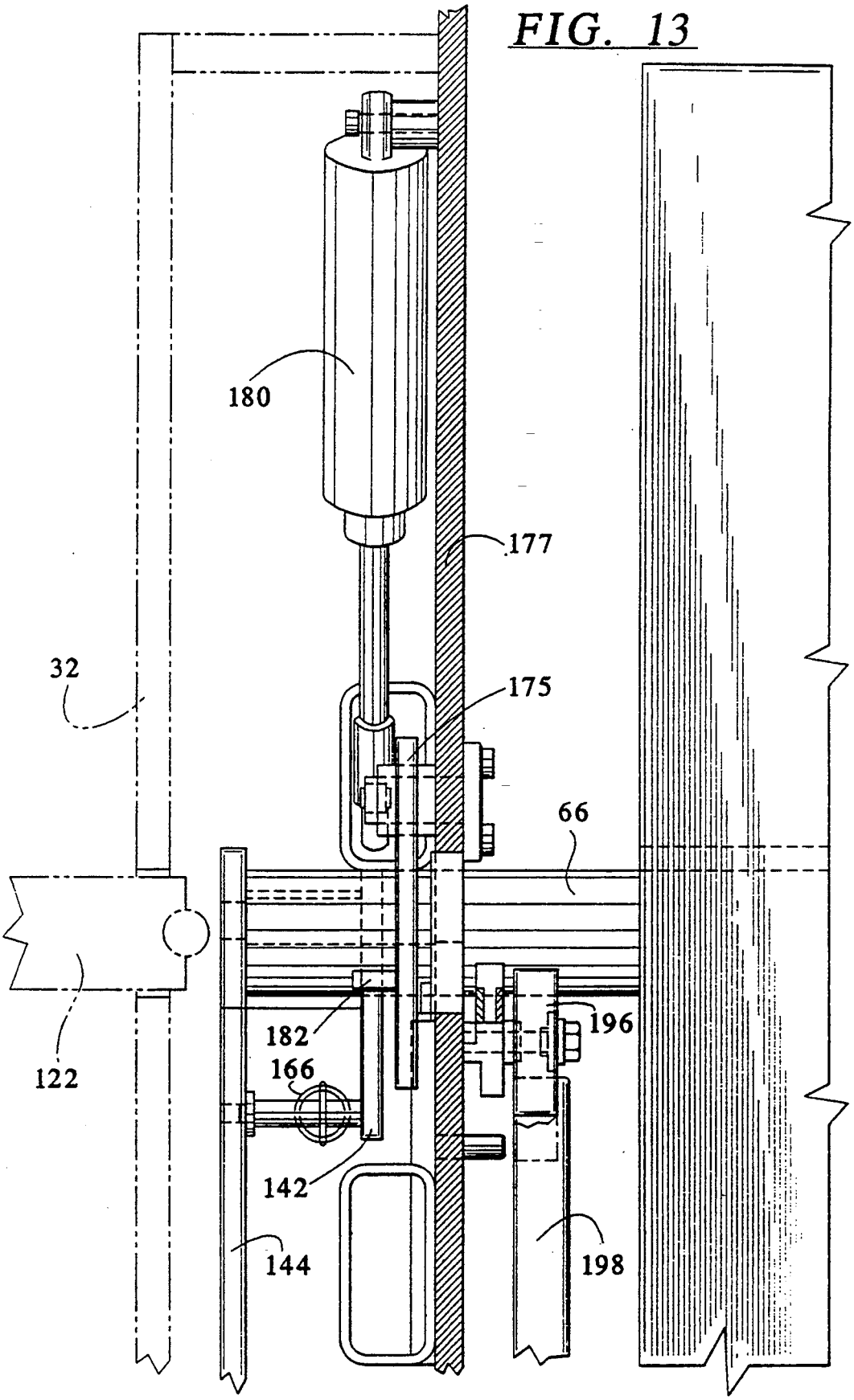
FIG. 13 is a partial side view of the fixed core retainer assembly.
Figure 14:
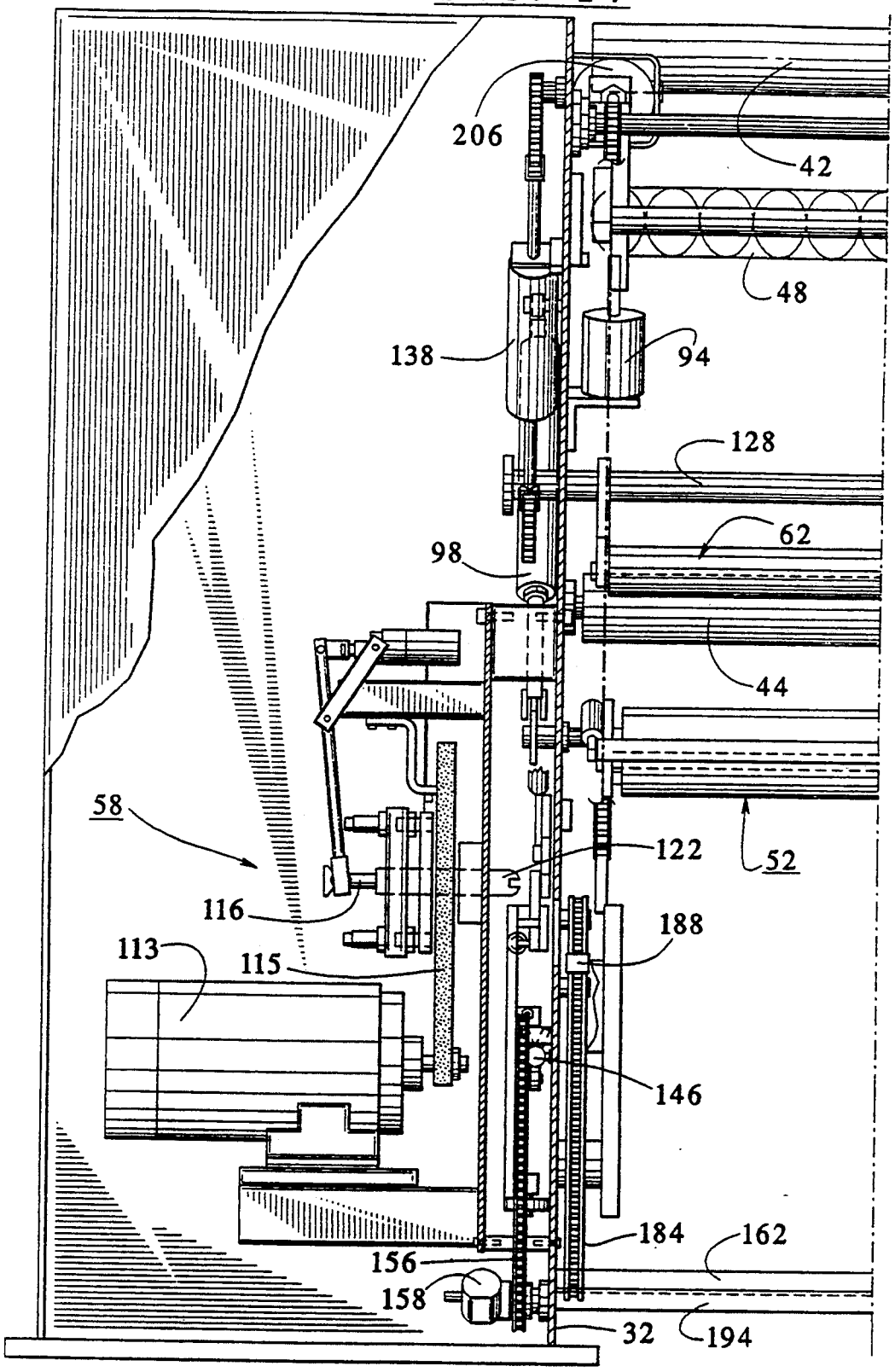
FIG. 14 is a partial end view of the operator side of the core winder of the flying paster of the present invention illustrating the fixed drive assembly.
Figure 15:
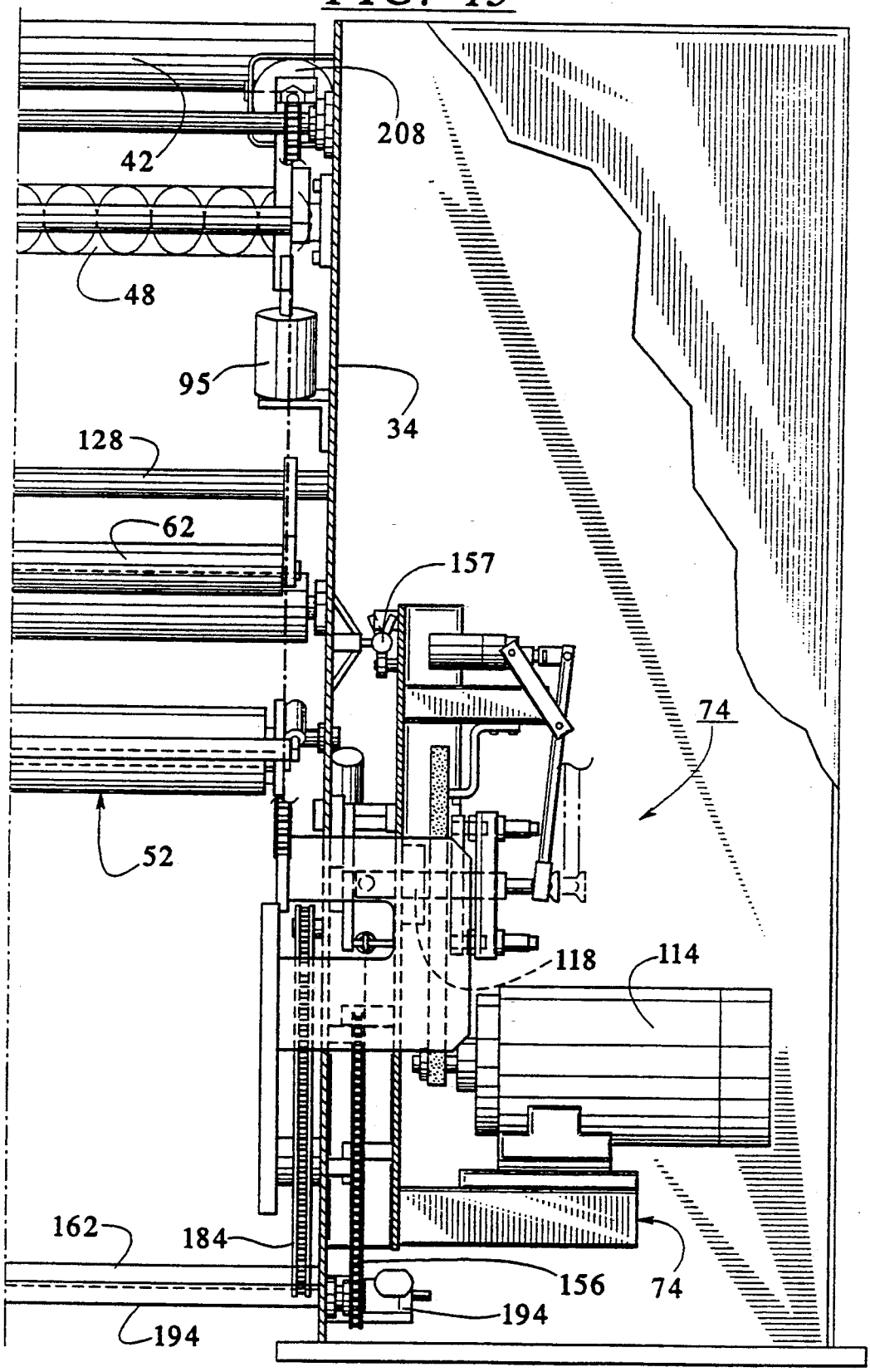
FIG. 15 is a partial end view of the drive or gear side of the flying paster core winder of the present invention illustrating the movable drive assembly.

A pair of dump assist wheels 196, best shown in FIGS. 7, 12 and 13, are utilized to initiate movement of the shaft 56 along the inclined move rail 150. Each of the wheels 196 is mounted on one end of a core dump assist pivot arm 198, with one of the arms 198 being mounted on the housing 32 and the other being mounted on the housing 34. More specifically, the arms 198 are mounted, between their ends, by pins 202 so that they may pivot about the axes of those pins. Each of the other ends of the arms 198 is connected to one end of core dump assist coil springs 204 such that the springs 204 bias the wheels 196 downwardly and in a counterclockwise direction around the mounting pins 202, as shown in FIG. 12. The other ends of the springs 204 are attached to their respective housings 32 and 34.

As noted above, once a predetermined amount of web has been wound onto a center core shaft (such as the shaft 56) positioned in the operating position, the web 24 is spliced onto a new center core shaft disposed in the splice position. After a splice has been accomplished, rotation of the roll in the operating position (such as the roll 54) is stopped. The retainer plates 175 are then returned, by actuation of the cylinders 180 and 180', back to their upper positions, as shown in phantom lines in FIG. 12. The wheels 196, which are in contact with the upstream side of the center core shaft 56, urge the shaft, under the bias of the spring 204, to move along the inclined move rail 150 toward the end 38. Movement of the shaft 56, and thus the roll 54, along this portion of the move rail 150 (the shaft in this position is shown at 56' in FIGS. 5 and 6) is controlled by the chains 184 and their core dump tabs 188.

As stated above, the roll unload assembly 86 includes a pair of roll unload arms 82 and 84. The hooked ends 78 of these arms projects beyond the end of 38 of the core winder 22. The other ends of the arms 82 and 84 are pivotally mounted on the housings 32 and 34, respectively, between the side facing walls of these housings and are adapted to be moved between a upper position and a lower position. When the arms 82 and 84 are in their upper position, they are adapted to receive the ends of the core center shaft 56 as those ends move down the incline portion of the move rail 150. After the endless chains 184 pass about the sprockets 186, which are adjacent to the end 38, the center core shaft 56, and roll 54, will be supported entirely by the arms 82 and 84 and will continue to roll or slide along the arms until the shaft is "caught" by the hooked ends 78 (as shown by 56" in FIGS. 5 and 6). When the arms 82 and 84 are moved to their lower position, the roll 54 (shown by 54" in FIGS. 5 and 6) may be easily removed from the arms and transported to storage.

Double acting fluid cylinders 206 and 208 cause the arms 82 and 84, respectively, to move between their upper and lower positions. Chains 212 and 214 connect the ends of the cylinders 206 and 208, respectively, with members 216 and 218 that are attached to the arms 82 and 84, respectively. The chains 212 and 214 pass around sprockets 222 and 224 mounted on the ends of a cross rod 226. The cross rod 226 is supported by the housings 32 and 34. Actuation of the cylinders 206 and 208 thus results the arms 82 and 84 being raised and lowered between their upper and lower positions.

The control circuitry for the functioning of the core winder 22 includes a Motorola micro-controller chip, identified by the Motorola No. 68HC 11 D 3 and manufactured by the Motorola Corporation of Schaumburg, Ill. This chip is used with a printed circuit board having conventional components. The following copyrighted ladder-logic program is used by the control circuitry to control the operation of the winder 22 as described as follows:

```
***** L O G I C   T A B L E   O F   C O N T E N T S *****

RMAP                                  1

_MAIN                                 2
   variable table                     3
   logic                              5
```

```
(*****************************************************************************)
(*                                                                           *)
(*                              BLOCK:  _MAIN                                *)
(*                                                                           *)
(*                                                                           *)
(*                          BLOCK SIZE (BYTES):   950                        *)
(*                      DECLARATIONS (ENTRIES):   123                        *)
(*                                                                           *)
(*                                                                           *)
(*                        HIGHEST REFERENCE USED                             *)
(*                     ----------------------------                          *)
(*                                                                           *)
(*                            INPUT (%I):   %I0035                           *)
(*                           OUTPUT (%Q):   %Q0034                           *)
(*                         INTERNAL (%M):   %M0600                           *)
(*                       GLOBAL DATA (%G):     NONE                          *)
(*                         TEMPORARY (%T):     NONE                          *)
(*                          REGISTER (%R):   %R0402                          *)
(*                     ANALOG INPUT (%AI):   %AI005                          *)
(*                    ANALOG OUTPUT (%AQ):   %AQ002                          *)
(*                                                                           *)
(*****************************************************************************)

[  START OF LD  PROGRAM  RMAP    ]      (*                                  *)
[     VARIABLE DECLARATIONS      ]
```

V A R I A B L E  D E C L A R A T I O N  T A B L E

| REFERENCE | NICKNAME | REFERENCE DESCRIPTION |
|---|---|---|
| %I0001 | DRV-RUN | DRIVE RUN |
| %I0002 | COR-DIA | CORE DIA. SELECT |
| %I0003 | DRV-STP | DRIVE STOP |
| %I0004 | A-P-ENG | A PREP & ENGAGE |
| %I0005 | A-DISNG | A DISENGAGE |
| %I0006 | B-P-ENG | B PREP & ENGAGE |
| %I0007 | | |
| %I0008 | B-DISNG | B DISENGAGE & UNLOAD |
| %I0009 | WXFR-PB | MANUAL WEB XFER. |
| %I0010 | WXFR-MD | WEB XFER MODE |
| %I0011 | A-THRM | A MOTOR THREM |
| %I0012 | B-THRM | B MOTOR THREM |
| %I0013 | B-UN-LS | B UNLOAD POS. LIMIT |
| %I0014 | PREP-LS | A PREP POS. LIMIT |
| %I0015 | WXFR-LS | A WEB TRANSFER LIMIT |
| %I0016 | E-STOP | PROCESS E-STOP |
| %I0017 | A-FAULT | A DRIVE FAULT |
| %I0018 | B-FAULT | B DRIVE FAULT |
| %I0019 | DCM-FLT | DCM FAULT |
| %I0020 | | |
| %I0021 | CUTCOMP | SPLICE & CUT COMPLETE |
| %I0022 | AENG-LS | A ENGAGED LIMIT |
| %I0023 | BENG-LS | B ENGAGED LIMIT |
| %I0024 | IDLE | IDLE RUN |
| %I0025 | A-ACCEL | A ACCELERATING |
| %I0026 | B-ACCEL | B ACCELERATING |
| %I0027 | DXFR-LS | A DRIVE TRANSFER LIMIT |
| %I0028 | MATCH | A-B SPEED MATCH |
| %I0029 | D-SLCT | MANUAL DRIVE SELECT |
| %I0030 | NIP-RST | NIP ROLLER RESET (LAY-ON) |
| %I0031 | PRO-RUN | PROCESS RUN MODE |
| %I0032 | LAY-ON | LAY-ON ROLLER |
| %I0033 | PREPRDY | PREP READY |
| %I0034 | DOR-PRX | DOOR PROX |
| %I0035 | PREPPRX | PREP. GATE PROX |
| %Q0001 | WBRK-CR | WEB BREAK RELAY |
| %Q0002 | DRV-FLT | DRIVE FAULT |
| %Q0003 | A-SLCT | A DRIVE SELECT LT |
| %Q0004 | CUT | CUT SOLENOID |
| %Q0005 | B-SLCT | B DRIVE SELECT LT |
| %Q0006 | SYS-FLT | SYSTEM FAULT |
| %Q0007 | A-TRACK | A TRACK ENABLE (DCM) |
| %Q0008 | B-TRACK | B TRACK ENABLE (DCM) |

| | | |
|---|---|---|
| %Q0009 | ARUN-EN | A RUN ENABLE (DCM) |
| %Q0010 | BRUN-EN | B RUN ENABLE (DCM) |
| %Q0011 | DIA-SLT | DIA. SELECT H=6 L=5.75 |
| %Q0012 | LG-D-R | 6 DIA. RESET "A" RETURN |
| %Q0013 | APID-EN | A PID ENABLE (DCM) |
| %Q0014 | BPID-EN | B PID ENABLE (DCM) |
| %Q0015 | ADIA-RS | A DIA. RESET (DCM) |
| %Q0016 | BDIA-RS | B DIA. RESET (DCM) |
| %Q0017 | WXFR-LT | WEB TRANSFER LIGHT |
| %Q0018 | LAY-ROL | LAY-ON ROLLER ENGAGE |
| %Q0019 | WXFR-PS | ENGAGE WEB TRANSFER POS. |
| %Q0020 | NIP | NIP SOLENOID |
| %Q0021 | B-ENG | B DRIVE ENGAGE |
| %Q0022 | A-DENG | A DRIVE ENGAGE |
| %Q0023 | KPR-DIS | B CORE KEEPER DISENGAGE |
| %Q0024 | HOIST | B UNLOAD HOIST |
| %Q0025 | A-POS-1 | A MOVE TO WXFER & DXFER |
| %Q0026 | A-POS-2 | A RETURN TO PREP POS. |
| %Q0027 | B-UNLD | B MOVE TO UNLOAD |
| %Q0028 | PRP-RDY | LOAD PREP READY |
| %Q0029 | M-D-SLT | MANUAL DRIVE SELECT |
| %Q0030 | A-D-SLT | AUTO DRIVE SELECT |
| %Q0031 | RUN-LT | RUN ENABLE LIGHT |
| %Q0032 | IDLE-R | IDLE RUN |
| %Q0033 | HOIST-L | HOIST WARNING LIGHT |
| %M0001 | REW-FLT | REWIND FAULT |
| %M0002 | DNCR-H | DANCER HIGH LIMIT |
| %M0003 | D-RUN | DRIVE RUN ENABLE |
| %M0004 | DNCR-L | DANCER LOW LIMIT |
| %M0005 | A-ENG | A DRIVE ENGAGE |
| %M0006 | A-DISEN | A DRIVE DISENGAGE |
| %M0007 | P-READY | A PREP READY |
| %M0008 | D-STOP | DRIVE STOP RUN DISABLE |
| %M0009 | DRV-SLT | DRIVE SELECT |
| %M0010 | A-M-WXF | A MOVE TO WEB XFER POS. |
| %M0011 | A-RUN-S | A RUN SELECT |
| %M0012 | B-RUN-S | B RUN SELECT |
| %M0013 | A-RUN-E | A RUN ENABLE |
| %M0014 | B-RUN-E | B RUN ENABLE |
| %M0015 | BUNLOAD | B UNLOAD |
| %M0016 | M-DXFER | A MOVE TO DXFER POS. |
| %M0017 | DXFER | START DRIVE XFER |
| %M0018 | A-B-D-X | A TO B DRIVE XFER |
| %M0019 | S-MATCH | A-B DRIVE SPEED MATCH |
| %M0020 | B-D-ENG | B DRIVE ENGAGE |
| %M0021 | PREPPOS | A PREP POSITION |
| %M0022 | A-PRP-R | A RETURN TO PREP POS. |
| %M0025 | S-WXFER | START WEB XFER |
| %M0026 | M-WXFER | MAKE WEB XFER |
| %M0027 | B-RC-L | B ROLL CHNG LATCH |
| %M0028 | DIS-DLY | B ROLL DISENGAGE DELAY |
| %M0029 | WXFER-L | WEB XFER LATCH |
| %M0030 | DIS-LAY | DISENGAGE LAY-ON ROLLER |
| %M0031 | | |
| %M0032 | | |
| %M0036 | M-DXFRL | MOVE TO DXFER LATCH |
| %M0037 | MK-DXFR | MAKE DXFER LATCH |
| %M0045 | S-WXFRL | START WXFER LATCH |
| %M0046 | M-WXFRL | MAKE WXFER LATCH |
| %M0049 | SPD-M-L | SPEED MATCH LATCH |
| %M0055 | MAN-W-X | MANUAL WXFER LATCH |
| %M0056 | WXFR-S | WXFER MODE SELECT |
| %M0057 | P-C-DLY | PASTE CUT DELAY |
| %M0400 | E-STP-D | E-STOP DELAY |
| %M0500 | PREP-A | PREP TO "A" SPINDLE |
| %M0501 | PREP-B | PREP TO "B" SPINDLE |
| %M0502 | B-PRP-L | B PREP LATCH |
| %M0503 | RTEN-A | A RETURN TO PREP |
| %M0600 | B-PRP-U | NOT RUN B UNLOAD PREP |
| %R0001 | A-M-R-D | A MOVE TO RUN POS. DELAY |
| %R0010 | A-DENGD | A DISENGAGE DELAY |
| %R0030 | B-DENGD | B DISENGAGE DELAY |
| %R0040 | MAN-CUT | MANUAL CUT DELAY |
| %AI001 | TEN-SET | TENSION SETPOINT |
| %AI002 | A-DIA-C | A DIA. CAL. |
| %AI003 | B-DIA-C | B DIA. CAL. |
| %AI004 | MAX-DIA | MAXIMUM DIAMETER SETPOINT |

| | | |
|---|---|---|
| %AQ001 | TEN-REF | TENSION REFERENCE TO DANCER I/P |
| %AQ002 | TEN-RFM | TENSION REFERENCE TO METER |

I D E N T I F I E R  T A B L E

| IDENTIFIER | IDENTIFIER TYPE | IDENTIFIER DESCRIPTION |
|---|---|---|
| RMAP | PROGRAM NAME | |

```
|[       BLOCK DECLARATIONS       ]
|
|[     START OF PROGRAM LOGIC     ]
| << RUNG 4  STEP #0001 >>
|
|A MOTOR                                                                REWIND
|THREM                                                                  FAULT
|A-THRM                                                                 REW-FLT
|%I0011                                                                 %M0001
+--]/[--+-----------------------------------------------------------------( )--
|       |
|B MOTOR|
|THREM  |
|B-THRM |
|%I0012 |
+--]/[--+
|       |
|A DRIVE|
|FAULT  |
|A-FAULT|
|%I0017 |
+--]/[--+
|       |
|B DRIVE|
|FAULT  |
|B-FAULT|
|%I0018 |
+--]/[--+
|       |
|DCM    |
|FAULT  |
|DCM-FLT|
|%I0019 |
+--]/[--+
|
|     #0001  LD   NOT  %I0011
|     #0002  OR   NOT  %I0012
|     #0003  OR   NOT  %I0017
|     #0004  OR   NOT  %I0018
|     #0005  OR   NOT  %I0019
|     #0006  OUT       %M0001
|
```

| REFERENCE | NICKNAME | REFERENCE DESCRIPTION |
|---|---|---|
| %I0017 | A-FAULT | A DRIVE FAULT |
| %I0011 | A-THRM | A MOTOR THREM |
| %I0018 | B-FAULT | B DRIVE FAULT |
| %I0012 | B-THRM | B MOTOR THREM |
| %I0019 | DCM-FLT | DCM FAULT |
| %M0001 | REW-FLT | REWIND FAULT |

```
<< RUNG 5  STEP #0007 >>

                                                                    DANCER
REWIND                                                              HIGH
FAULT                                                               LIMIT
REW-FLT                                                             DNCR-H
%M0001  +------+                                                    %M0002
+--]/[---+ GT_  |+-------------------------------------------------------( )--
         | INT  ||
         |      ||
%AI005 -+I1   Q++
         |
 CONST -+I2    |
 +06000 +------+

     #0007  LD   NOT  %M0001
     #0008  FUNC 57   GT
                 P1:  %AI005
                 P2:  +06000
     #0009  OUT       %M0002

<< RUNG 6  STEP #0010 >>

                                                                    DANCER
REWIND                                                              LOW
FAULT                                                               LIMIT
REW-FLT                                                             DNCR-L
%M0001  +------+                                                    %M0004
+--]/[---+ LT_  |+-------------------------------------------------------( )--
         | INT  ||
         |      ||
%AI005 -+I1   Q++
         |
 CONST -+I2    |
 +00060 +------+

     #0010  LD   NOT  %M0001
     #0011  FUNC 56   LT
                 P1:  %AI005
                 P2:  +00060
     #0012  OUT       %M0004
```

| REFERENCE | NICKNAME | REFERENCE DESCRIPTION |
|---|---|---|
| %AI005 | | |
| %M0002 | DNCR-H | DANCER HIGH LIMIT |
| %M0004 | DNCR-L | DANCER LOW LIMIT |
| %M0001 | REW-FLT | REWIND FAULT |

```
<< RUNG 7  STEP #0013 >>

REWIND                                                          DRIVE
FAULT                                                           FAULT
REW-FLT                                                         DRV-FL
%M0001                                                          %Q0002
+--] [--+-------------------------------------------------------( )
        |                                                       SYSTEM
        |                                                       FAULT
        |                                                       SYS-FL
        |                                                       %Q0006
        +-------------------------------------------------------( )--

     #0013  LD        %M0001
     #0014  OUT       %Q0002
     #0015  OUT       %Q0006

<< RUNG 8  STEP #0016 >>

PROCESS                                                         E-STOP
E-STOP                                                          DELAY
E-STOP                                                          E-STP-
%I0016  +-----+                                                 %M0400
+--]/[---+ TMR +------------------------------------------------( )
         |0.10s|
         |     |
 CONST -+PV    |
 +00030 |      |
        +-----+

        %R0400

     #0016  LD   NOT  %I0016
     #0017  FUNC 10   TMR
                 P1:   00010
                 P2:  +00030
                 P3:  %R0400
     #0018  OUT       %M0400
```

| REFERENCE | NICKNAME | REFERENCE DESCRIPTION |
|---|---|---|
| %R0400 | | |
| %Q0002 | DRV-FLT | DRIVE FAULT |
| %I0016 | E-STOP | PROCESS E-STOP |
| %M0400 | E-STP-D | E-STOP DELAY |
| %M0001 | REW-FLT | REWIND FAULT |
| %Q0006 | SYS-FLT | SYSTEM FAULT |

```
<< RUNG 9  STEP #0019 >>

                                DRIVE
                                STOP     DANCER   DANCER   PREP.                          DRIVE
DRIVE    E-STOP   REWIND       RUN      HIGH     LOW      GATE                           RUN
RUN      DELAY    FAULT        DISABLE  LIMIT    LIMIT    PROX                           ENABLE
DRV-RUN  E-STP-D  REW-FLT      D-STOP   DNCR-H   DNCR-L   PREPPRX                         D-RUN
%I0001   %M0400   %M0001       %M0008   %M0002   %M0004   %I0035                         %M0003
+--] [--+--]/[-----]/[-----]/[-----]/[-----] [-----] [--+------------------( )--
|       |                                                |
DRIVE   |                                                |                RUN
RUN     |                                                |                ENABLE
ENABLE  |                                                |                LIGHT
 D-RUN  |                                                |                RUN-LT
%M0003  |                                                |                %Q0031
+--] [--+                                                +------------------( )--
|
     #0019  LD        %I0001
     #0020  OR        %M0003
     #0021  AND  NOT  %M0400
     #0022  AND  NOT  %M0001
     #0023  AND  NOT  %M0008
     #0024  AND  NOT  %M0002
     #0025  AND       %M0004
     #0026  AND       %I0035
     #0027  OUT       %M0003
     #0028  OUT       %Q0031

<< RUNG 10  STEP #0029 >>

DRIVE                                                                                   MANUAL
RUN                                                                                     DRIVE
ENABLE                                                                                  SELECT
 D-RUN                                                                                  M-D-SLT
%M0003                                                                                  %Q0029
+--]/[-------------------------------------------------------------------------------( )--
|
     #0029  LD   NOT  %M0003
     #0030  OUT       %Q0029
```

| REFERENCE | NICKNAME | REFERENCE DESCRIPTION |
|---|---|---|
| %M0003 | D-RUN | DRIVE RUN ENABLE |
| %M0008 | D-STOP | DRIVE STOP RUN DISABLE |
| %M0002 | DNCR-H | DANCER HIGH LIMIT |
| %M0004 | DNCR-L | DANCER LOW LIMIT |
| %I0001 | DRV-RUN | DRIVE RUN |
| %M0400 | E-STP-D | E-STOP DELAY |
| %Q0029 | M-D-SLT | MANUAL DRIVE SELECT |
| %I0035 | PREPPRX | PREP. GATE PROX |
| %M0001 | REW-FLT | REWIND FAULT |
| %Q0031 | RUN-LT | RUN ENABLE LIGHT |

```
<< RUNG 11  STEP #0031 >>

                                                                    DRIVE
                                                                    STOP
DRIVE                                                               RUN
STOP                                                                DISABLE
DRV-STP                                                             D-STOP
%I0003                                                              %M0008
+--] [-------------------------------------------------------------( )--

     #0031  LD        %I0003
     #0032  OUT       %M0008

<< RUNG 12  STEP #0033 >>

MANUAL
DRIVE                                                               DRIVE
SELECT                                                              SELECT
D-SLCT                                                              DRV-SLT
%I0029                                                              %M0009
+--] [-------------------------------------------------------------( )--

     #0033  LD        %I0029
     #0034  OUT       %M0009

<< RUNG 13  STEP #0035 >>

DRIVE                                                               A RUN
SELECT                                                              SELECT
DRV-SLT                                                             A-RUN-S
%M0009                                                              %M0011
+--]/[-------------------------------------------------------------( )--

     #0035  LD   NOT  %M0009
     #0036  OUT       %M0011
```

| REFERENCE | NICKNAME | REFERENCE DESCRIPTION |
|---|---|---|
| %M0011 | A-RUN-S | A RUN SELECT |
| %I0029 | D-SLCT | MANUAL DRIVE SELECT |
| %M0008 | D-STOP | DRIVE STOP RUN DISABLE |
| %M0009 | DRV-SLT | DRIVE SELECT |
| %I0003 | DRV-STP | DRIVE STOP |

```
| << RUNG 14  STEP #0037 >>
|
| A PREP                                                          A PREP
| POS.                                                            POSITIO
| LIMIT                                                           N
| PREP-LS                                                         PREPPOS
| %I0014                                                          %M0021
+--] [-----------------------------------------------------------( )--
|
|     #0037  LD        %I0014
|     #0038  OUT       %M0021
|
| << RUNG 15  STEP #0039 >>
|
|                                                                 A DRIVE
| A RUN                                                           SELECT
| SELECT                                                          LT
| A-RUN-S                                                         A-SLCT
| %M0011                                                          %Q0003
+--] [-----------------------------------------------------------( )--
|
|     #0039  LD        %M0011
|     #0040  OUT       %Q0003
|
| << RUNG 16  STEP #0041 >>
|
| DRIVE                                                           B RUN
| SELECT                                                          SELECT
| DRV-SLT                                                         B-RUN-S
| %M0009                                                          %M0012
+--] [-----------------------------------------------------------( )--
|
|     #0041  LD        %M0009
|     #0042  OUT       %M0012
|
| << RUNG 17  STEP #0043 >>
|
|                                                                 B DRIVE
| B RUN                                                           SELECT
| SELECT                                                          LT
| B-RUN-S                                                         B-SLCT
| %M0012                                                          %Q0005
+--] [-----------------------------------------------------------( )--
|
----- IL TEXT FOR RUNG CONTINUED NEXT PAGE -----
```

| REFERENCE | NICKNAME | REFERENCE DESCRIPTION |
|---|---|---|
| %M0011 | A-RUN-S | A RUN SELECT |
| %Q0003 | A-SLCT | A DRIVE SELECT LT |
| %M0012 | B-RUN-S | B RUN SELECT |
| %Q0005 | B-SLCT | B DRIVE SELECT LT |
| %M0009 | DRV-SLT | DRIVE SELECT |
| %I0014 | PREP-LS | A PREP POS. LIMIT |
| %M0021 | PREPPOS | A PREP POSITION |

```
|     #0043  LD        %M0012
|     #0044  OUT       %Q0005

|  << RUNG 18  STEP #0045 >>

|A PREP          A DRIVE A TO B
|&       A PREP  DISENGA DRIVE   B PREP                                    A DRIVE
|ENGAGE  READY   GE      XFER    LATCH                                     ENGAGE
|A-P-ENG P-READY A-DISEN A-B-D-X B-PRP-L                                    A-ENG
|%I0004  %M0007  %M0006  %M0018  %M0502                                    %M0005
+--] [-----] [--+--]/[-----]/[-----]/[-------------------------------------( )--
|                |
|A DRIVE         |
|ENGAGE          |
| A-ENG          |
|%M0005          |
+--] [----------+
|
|     #0045  LD        %I0004
|     #0046  AND       %M0007
|     #0047  OR        %M0005
|     #0048  AND  NOT  %M0006
|     #0049  AND  NOT  %M0018
|     #0050  AND  NOT  %M0502
|     #0051  OUT       %M0005

|  << RUNG 19  STEP #0052 >>

|A DRIVE A RUN                                                            A DRIV
|ENGAGE  ENABLE                                                           ENGAGE
| A-ENG  A-RUN-E                                                          A-DENG
|%M0005  %M0013                                                           %Q0022
+--]/[-----]/[---------------------------------------------------------( )--
|
|     #0052  LD   NOT  %M0005
|     #0053  AND  NOT  %M0013
|     #0054  OUT       %Q0022
|
```

| REFERENCE | NICKNAME | REFERENCE DESCRIPTION |
|---|---|---|
| %M0018 | A-B-D-X | A TO B DRIVE XFER |
| %Q0022 | A-DENG | A DRIVE ENGAGE |
| %M0006 | A-DISEN | A DRIVE DISENGAGE |
| %M0005 | A-ENG | A DRIVE ENGAGE |
| %I0004 | A-P-ENG | A PREP & ENGAGE |
| %M0013 | A-RUN-E | A RUN ENABLE |
| %M0502 | B-PRP-L | B PREP LATCH |
| %M0007 | P-READY | A PREP READY |

```
<< RUNG 20  STEP #0055 >>

                B ROLL                                                  LAY-
A DRIVE B       CHNG    LAY-ON                                          ROLL
ENGAGE  UNLOAD  LATCH   ROLLER                                          ENGAGE
 A-ENG  BUNLOAD B-RC-L  LAY-ON                                          LAY-RO
%M0005  %M0015  %M0027  %I0032                                          %Q0018
+--] [--+--]/[-----]/[-----] [-------------------------------------------( )-
        |
B DRIVE |
ENGAGE  |
B-D-ENG |
%M0020  |
+--] [--+
        |
     #0055  LD        %M0005
     #0056  OR        %M0020
     #0057  AND  NOT  %M0015
     #0058  AND  NOT  %M0027
     #0059  AND       %I0032
     #0060  OUT       %Q0018

<< RUNG 21  STEP #0061 >>

A                                                                       A DRIV
DISENGA                                                                 DISENG
GE                                                                      GE
A-DISNG                                                                 A-DISE
%I0005                                                                  %M0006
+--] [-----------------------------------------------------------------( )-
        |
     #0061  LD        %I0005
     #0062  OUT       %M0006
```

| REFERENCE | NICKNAME | REFERENCE DESCRIPTION |
|---|---|---|
| %M0006 | A-DISEN | A DRIVE DISENGAGE |
| %I0005 | A-DISNG | A DISENGAGE |
| %M0005 | A-ENG | A DRIVE ENGAGE |
| %M0020 | B-D-ENG | B DRIVE ENGAGE |
| %M0027 | B-RC-L | B ROLL CHNG LATCH |
| %M0015 | BUNLOAD | B UNLOAD |
| %I0032 | LAY-ON | LAY-ON ROLLER |
| %Q0018 | LAY-ROL | LAY-ON ROLLER ENGAGE |

```
<< RUNG 22  STEP #0063 >>

        A PREP  A DRIVE A DRIVE
PREP    POSITIO DISENGA TRANSFE                                          A PREP
READY   N       GE      R LIMIT                                          READY
PREPRDY PREPPOS A-DISEN DXFR-LS                                          P-READY
%I0033  %M0021  %M0006  %I0027                                           %M0007
+--] [-----] [--+--]/[-----]/[-----------------------------------------( )--
|               |
A PREP          |
READY           |
P-READY         |
%M0007          |
+--] [----------+
|
     #0063  LD        %I0033
     #0064  AND       %M0021
     #0065  OR        %M0007
     #0066  AND  NOT  %M0006
     #0067  AND  NOT  %I0027
     #0068  OUT       %M0007

<< RUNG 23  STEP #0069 >>

        A WEB                                                            LOAD
A PREP  TRANSFE                                                          PREP
READY   R LIMIT                                                          READY
P-READY WXFR-LS                                                          PRP-RD
%M0007  %I0015                                                           %Q0028
+--]/[-----]/[---------------------------------------------------------( )--
|
     #0069  LD   NOT  %M0007
     #0070  AND  NOT  %I0015
     #0071  OUT       %Q0028
```

| REFERENCE | NICKNAME | REFERENCE DESCRIPTION |
|---|---|---|
| %M0006 | A-DISEN | A DRIVE DISENGAGE |
| %I0027 | DXFR-LS | A DRIVE TRANSFER LIMIT |
| %M0007 | P-READY | A PREP READY |
| %M0021 | PREPPOS | A PREP POSITION |
| %I0033 | PREPRDY | PREP READY |
| %Q0028 | PRP-RDY | LOAD PREP READY |
| %I0015 | WXFR-LS | A WEB TRANSFER LIMIT |

```
<< RUNG 24  STEP #0072 >>

                                                                    A MOVE
                                                                    TO WEB
A DRIVE                                                             XFER
ENGAGE                                                              POS.
 A-ENG                                                              A-M-WXF
%M0005  +-----+                                                     %M0010
+--] [---+ TMR +-------------------------------------------------------( )--
         |0.10s|
         |     |
 CONST -+PV    |
 +00030 |      |
        +-----+
        A MOVE
        TO RUN
        POS.
        DELAY
        A-M-R-D
        %R0001

    #0072  LD        %M0005
    #0073  FUNC 10   TMR
                P1:   00010
                P2:  +00030
                P3:  %R0001
    #0074  OUT       %M0010

<< RUNG 25  STEP #0075 >>

A PREP                                                              PREP TO
&       DRIVE                                                       "A"
ENGAGE  SELECT                                                      SPINDLE
A-P-ENG DRV-SLT                                                     PREP-A
%I0004  %M0009                                                      %M0500
+--] [--+--]/[--+-------------------------------------------------------( )--
        |       |
        |DRIVE  |
        |RUN    |
        |ENABLE |
        | D-RUN |
        |%M0003 |
        +--] [--+
```

----- IL TEXT FOR RUNG CONTINUED NEXT PAGE -----

| REFERENCE | NICKNAME | REFERENCE DESCRIPTION |
|---|---|---|
| %M0005 | A-ENG | A DRIVE ENGAGE |
| %R0001 | A-M-R-D | A MOVE TO RUN POS. DELAY |
| %M0010 | A-M-WXF | A MOVE TO WEB XFER POS. |
| %I0004 | A-P-ENG | A PREP & ENGAGE |
| %M0003 | D-RUN | DRIVE RUN ENABLE |
| %M0009 | DRV-SLT | DRIVE SELECT |
| %M0500 | PREP-A | PREP TO "A" SPINDLE |

```
|      #0075  LD        %I0004
|      #0076  LD   NOT  %M0009
|      #0077  OR        %M0003
|      #0078  AND  BLK
|      #0079  OUT       %M0500

|  << RUNG 26  STEP #0080 >>

|B PREP          DRIVE                                                    PREP TO
|&       DRIVE   RUN      A PREP                                          "B"
|ENGAGE  SELECT  ENABLE   READY                                           SPINDLE
|B-P-ENG DRV-SLT  D-RUN   P-READY                                         PREP-B
|%I0006  %M0009  %M0003   %M0007                                          %M0501
+--] [-----] [-----]/[-----] [-----------------------------------------( )--
|
|      #0080  LD        %I0006
|      #0081  AND       %M0009
|      #0082  AND  NOT  %M0003
|      #0083  AND       %M0007
|      #0084  OUT       %M0501

|  << RUNG 27  STEP #0085 >>

|PREP TO A DRIVE
|"B"     TRANSFE                                                          B PREP
|SPINDLE R LIMIT                                                          LATCH
|PREP-B  DXFR-LS                                                          B-PRP-L
|%M0501  %I0027                                                           %M0502
+--] [--+--]/[-------------------------------------------------------( )-
|       |
|B PREP |
|LATCH  |
|B-PRP-L|
|%M0502 |
+--] [--+
|       |
|%M0505 |
+--] [--+
|
|      #0085  LD        %M0501
|      #0086  OR        %M0502
|      #0087  OR        %M0505
|      #0088  AND  NOT  %I0027
----- IL TEXT FOR RUNG CONTINUED NEXT PAGE -----
```

| REFERENCE | NICKNAME | REFERENCE DESCRIPTION |
|---|---|---|
| %M0505 | | |
| %I0006 | B-P-ENG | B PREP & ENGAGE |
| %M0502 | B-PRP-L | B PREP LATCH |
| %M0003 | D-RUN | DRIVE RUN ENABLE |
| %M0009 | DRV-SLT | DRIVE SELECT |
| %I0027 | DXFR-LS | A DRIVE TRANSFER LIMIT |
| %M0007 | P-READY | A PREP READY |
| %M0501 | PREP-B | PREP TO "B" SPINDLE |

```
|     #0089  OUT        %M0502
|
|  << RUNG 28  STEP #0090 >>
|
|         A PREP                                                          A
| B PREP  POS.                                                            RETURN
| LATCH   LIMIT                                                           TO PREP
| B-PRP-L PREP-LS                                                         RTEN-A
| %M0502  %I0014                                                          %M0503
+--] [--+--]/[-----------------------------------------------------------( )--
|       |
| A     |
| RETURN|
| TO PREP|
| RTEN-A|
| %M0503|
+--] [--+
|
|     #0090  LD         %M0502
|     #0091  OR         %M0503
|     #0092  AND  NOT   %I0014
|     #0093  OUT        %M0503
|
|  << RUNG 29  STEP #0094 >>
|
|         DRIVE    B PREP
| A RUN   RUN      &        DRIVE
| ENABLE  ENABLE   ENGAGE   SELECT
| A-RUN-E  D-RUN   B-P-ENG  DRV-SLT
| %M0013  %M0003   %I0006   %M0009                                        %M0505
+--] [-----] [-----] [--+--]/[-----------------------------------------( )--
|                        |
| %M0505                 |
+--] [------------------+
|
|     #0094  LD         %M0013
|     #0095  AND        %M0003
|     #0096  AND        %I0006
|     #0097  OR         %M0505
|     #0098  AND  NOT   %M0009
|     #0099  OUT        %M0505
|
```

| REFERENCE | NICKNAME | REFERENCE DESCRIPTION |
|---|---|---|
| %M0505 | | |
| %M0013 | A-RUN-E | A RUN ENABLE |
| %I0006 | B-P-ENG | B PREP & ENGAGE |
| %M0502 | B-PRP-L | B PREP LATCH |
| %M0003 | D-RUN | DRIVE RUN ENABLE |
| %M0009 | DRV-SLT | DRIVE SELECT |
| %I0014 | PREP-LS | A PREP POS. LIMIT |
| %M0503 | RTEN-A | A RETURN TO PREP |

```
<< RUNG 30  STEP #0100 >>

        A DRIVE
        TRANSFE
        R LIMIT
        DXFR-LS
%M0505  %I0027                                                          %M0506
+--] [-----] [-----------------------------------------------------------( )--

     #0100  LD        %M0505
     #0101  AND       %I0027
     #0102  OUT       %M0506

<< RUNG 31  STEP #0103 >>

A MOVE                                                                  A MOVE
TO WEB  A WEB   A DRIVE                                                 TO
XFER    TRANSFE TRANSFE                                                 WXFER
POS.    R LIMIT R LIMIT                                                 DXFER
A-M-WXF WXFR-LS DXFR-LS                                                 A-POS-
%M0010  %I0015  %I0027                                                  %Q0025
+--] [-----]/[--+--]/[--+-----------------------------------------------( )-
|               |       |
MOVE TO         |       |
DXFER           |       |
LATCH           |       |
M-DXFRL         |       |
%M0036          |       |
+--] [----------+       |
|                       |
B PREP                  |
LATCH                   |
B-PRP-L                 |
%M0502                  |
+--] [------------------+
|
     #0103  LD        %M0010
     #0104  AND  NOT  %I0015
     #0105  OR        %M0036
     #0106  AND  NOT  %I0027
     #0107  OR        %M0502
     #0108  OUT       %Q0025
```

| REFERENCE | NICKNAME | REFERENCE DESCRIPTION |
|---|---|---|
| %M0505 | | |
| %M0506 | | |
| %M0010 | A-M-WXF | A MOVE TO WEB XFER POS. |
| %Q0025 | A-POS-1 | A MOVE TO WXFER & DXFER |
| %M0502 | B-PRP-L | B PREP LATCH |
| %I0027 | DXFR-LS | A DRIVE TRANSFER LIMIT |
| %M0036 | M-DXFRL | MOVE TO DXFER LATCH |
| %I0015 | WXFR-LS | A WEB TRANSFER LIMIT |

```
| << RUNG 32  STEP #0109 >>
|
|                                                                                A
|A TO B  A PREP                                                                  RETURN
|DRIVE   POSITIO A RUN                                                           TO PRE
|XFER    N       ENABLE                                                          POS.
|A-B-D-X PREPPOS A-RUN-E                                                         A-PRP-
|%M0018  %M0021  %M0013                                                          %M0022
+--] [--+--]/[-----]/[--+-----------------------------------------------( )-
|       |               |
|A      |               |
|DISENGA|               |
|GE     |               |
|A-DISNG|               |
|%I0005 |               |
+--] [--+               |
|       |               |
|A      |               |
|RETURN |               |
|TO PREP|               |
|POS.   |               |
|A-PRP-R|               |
|%M0022 |               |
+--] [--+               |
|                       |
|A DRIVE A              |
|TRANSFE RETURN         |
|R LIMIT TO PREP        |
|DXFR-LS RTEN-A         |
|%I0027  %M0503         |
+--] [-----] [----------+
|
|     #0109  LD        %M0018
|     #0110  OR        %I0005
|     #0111  OR        %M0022
|     #0112  AND  NOT  %M0021
|     #0113  AND  NOT  %M0013
|     #0114  LD        %I0027
|     #0115  AND       %M0503
|     #0116  OR   BLK
|     #0117  OUT       %M0022
|
```

| REFERENCE | NICKNAME | REFERENCE DESCRIPTION |
|---|---|---|
| %M0018 | A-B-D-X | A TO B DRIVE XFER |
| %I0005 | A-DISNG | A DISENGAGE |
| %M0022 | A-PRP-R | A RETURN TO PREP POS. |
| %M0013 | A-RUN-E | A RUN ENABLE |
| %I0027 | DXFR-LS | A DRIVE TRANSFER LIMIT |
| %M0021 | PREPPOS | A PREP POSITION |
| %M0503 | RTEN-A | A RETURN TO PREP |

```
<< RUNG 33  STEP #0118 >>

A                                                                    A
RETURN                                                               RETURN
TO PREP                                                              TO PRE
POS.                                                                 POS.
A-PRP-R                                                              A-POS-
%M0022                                                               %Q0026
+--] [-------------------------------------------------------------( )-

     #0118  LD        %M0022
     #0119  OUT       %Q0026

<< RUNG 34  STEP #0120 >>

        DRIVE
A RUN   RUN                                                          A RUN
SELECT  ENABLE                                                       ENABLE
A-RUN-S  D-RUN                                                       A-RUN-
%M0011  %M0003                                                       %M0013
+--] [-----] [-----------------------------------------------------( )-

     #0120  LD        %M0011
     #0121  AND       %M0003
     #0122  OUT       %M0013

<< RUNG 35  STEP #0123 >>

                                                                     A TRAC
A RUN   A RUN                                                        ENABLE
ENABLE  SELECT                                                       (DCM)
A-RUN-E A-RUN-S                                                      A-TRAC
%M0013  %M0011                                                       %Q0007
+--] [-----] [-----------------------------------------------------( )-

     #0123  LD        %M0013
     #0124  AND       %M0011
     #0125  OUT       %Q0007
```

| REFERENCE | NICKNAME | REFERENCE DESCRIPTION |
|---|---|---|
| %Q0026 | A-POS-2 | A RETURN TO PREP POS. |
| %M0022 | A-PRP-R | A RETURN TO PREP POS. |
| %M0013 | A-RUN-E | A RUN ENABLE |
| %M0011 | A-RUN-S | A RUN SELECT |
| %Q0007 | A-TRACK | A TRACK ENABLE (DCM) |
| %M0003 | D-RUN | DRIVE RUN ENABLE |

```
<< RUNG 36  STEP #0126 >>

                                                                    A RUN
A RUN                                                               ENABLE
ENABLE                                                              (DCM)
A-RUN-E                                                             ARUN-E
%M0013                                                              %Q0009
+--] [--+-------------------------------------------------------------( )-
        |
START   |
WXFER   |
LATCH   |
S-WXFRL |
%M0045  |
+--] [--+

     #0126  LD        %M0013
     #0127  OR        %M0045
     #0128  OUT       %Q0009

<< RUNG 37  STEP #0129 >>

                                                                    A PID
A RUN    A RUN                                                      ENABLE
ENABLE   SELECT                                                     (DCM)
A-RUN-E  A-RUN-S                                                    APID-
%M0013   %M0011                                                     %Q001
+--] [-----] [--------------------------------------------------------( )-

     #0129  LD        %M0013
     #0130  AND       %M0011
     #0131  OUT       %Q0013
```

| REFERENCE | NICKNAME | REFERENCE DESCRIPTION |
|---|---|---|
| %M0013 | A-RUN-E | A RUN ENABLE |
| %M0011 | A-RUN-S | A RUN SELECT |
| %Q0013 | APID-EN | A PID ENABLE (DCM) |
| %Q0009 | ARUN-EN | A RUN ENABLE (DCM) |
| %M0045 | S-WXFRL | START WXFER LATCH |

```
<< RUNG 38  STEP #0132 >>

                                                                    A MOVE
                                                                    TO
A RUN                                                               DXFER
ENABLE                                                              POS.
A-RUN-E                                                             M-DXF..
%M0013  +-----+                                                     %M0016
+--] [---+ GE  |+-------------------------------------------------------( )--
         | INT |
         |     |
A DIA.   |     |
CAL.     |     |
A-DIA-C  |     |
%AI002 -+I1  Q++
         |     |
 CONST -+I2    |
 +06432 +-----+

     #0132  LD         %M0013
     #0133  FUNC 55    GE
                P1:    %AI002
                P2:    +06432
     #0134  OUT        %M0016

<< RUNG 39  STEP #0135 >>

A MOVE
TO                DRIVE                                             MOVE TO
DXFER   B RUN     RUN                                               DXFER
POS.    SELECT    ENABLE                                            LATCH
M-DXFER B-RUN-S    D-RUN                                            M-DXFRL
%M0016  %M0012    %M0003                                            %M0036
+--] [--+--]/[-----] [-------------------------------------------------( )--
        |
MOVE TO |
DXFER   |
LATCH   |
M-DXFRL |
%M0036  |
+--] [--+
|
|    #0135  LD         %M0016
|    #0136  OR         %M0036
|    #0137  AND  NOT   %M0012
----- IL TEXT FOR RUNG CONTINUED NEXT PAGE -----
```

| REFERENCE | NICKNAME | REFERENCE DESCRIPTION |
|---|---|---|
| %AI002 | A-DIA-C | A DIA. CAL. |
| %M0013 | A-RUN-E | A RUN ENABLE |
| %M0012 | B-RUN-S | B RUN SELECT |
| %M0003 | D-RUN | DRIVE RUN ENABLE |
| %M0016 | M-DXFER | A MOVE TO DXFER POS. |
| %M0036 | M-DXFRL | MOVE TO DXFER LATCH |

```
|     #0138  AND        %M0003
|     #0139  OUT        %M0036

|  << RUNG 40  STEP #0140 >>

|MOVE TO A DRIVE                                                    B DIA.
|DXFER   TRANSFE                                                    RESET
|LATCH   R LIMIT                                                    (DCM)
|M-DXFRL DXFR-LS                                                    BDIA-RS
|%M0036  %I0027                                                     %Q0016
+--] [-----]/[-----------------------------------------------------------( )--
|
|     #0140  LD         %M0036
|     #0141  AND  NOT   %I0027
|     #0142  OUT        %Q0016

|  << RUNG 41  STEP #0143 >>

|                                                                   START
|A RUN                                                              DRIVE
|ENABLE                                                             XFER
|A-RUN-E                                                             DXFER
|%M0013  +------+                                                   %M0017
+--] [---+ GE_  |+-----------------------------------------------------------( )--
|        | INT  ||
|        |      ||
|A DIA.  |      ||
|CAL.    |      ||
|A-DIA-C |      ||
|%AI002 -+I1   Q++
|        |
|  CONST -+I2    |
|  +07239 +------+

|     #0143  LD         %M0013
|     #0144  FUNC 55    GE
|                 P1:   %AI002
|                 P2:   +07239
|     #0145  OUT        %M0017
```

| REFERENCE | NICKNAME | REFERENCE DESCRIPTION |
|---|---|---|
| %AI002 | A-DIA-C | A DIA. CAL. |
| %M0013 | A-RUN-E | A RUN ENABLE |
| %Q0016 | BDIA-RS | B DIA. RESET (DCM) |
| %M0017 | DXFER | START DRIVE XFER |
| %I0027 | DXFR-LS | A DRIVE TRANSFER LIMIT |
| %M0036 | M-DXFRL | MOVE TO DXFER LATCH |

```
<< RUNG 42  STEP #0146 >>

START            DRIVE                                                  MAKE
DRIVE   B RUN    RUN                                                    DXFER
XFER    SELECT   ENABLE                                                 LATCH
 DXFER  B-RUN-S   D-RUN                                                 MK-DXFF
%M0017  %M0012   %M0003                                                 %M0037
+--] [--+--]/[-----] [-----------------------------------------------( )--
|       |
MAKE    |
DXFER   |
LATCH   |
MK-DXFR |
%M0037  |
+--] [--+
|
     #0146  LD        %M0017
     #0147  OR        %M0037
     #0148  AND  NOT  %M0012
     #0149  AND       %M0003
     #0150  OUT       %M0037

<< RUNG 43  STEP #0151 >>

A
RETURN                                                                  A DIA.
TO PREP                                                                 RESET
POS.                                                                    (DCM)
A-PRP-R                                                                 ADIA-RS
%M0022  +------+                                                        %Q0015
+--] [---+ TMR +-------------------------------------------------------( )--
         |0.10s|
         |     |
 CONST -+PV    |
 +00050  |     |
         +------+

         %R0120

     #0151  LD        %M0022
     #0152  FUNC 10   TMR
                P1:   00010
                P2:  +00050
                P3:  %R0120
----- IL TEXT FOR RUNG CONTINUED NEXT PAGE -----
```

| REFERENCE | NICKNAME | REFERENCE DESCRIPTION |
|---|---|---|
| %R0120 | | |
| %M0022 | A-PRP-R | A RETURN TO PREP POS. |
| %Q0015 | ADIA-RS | A DIA. RESET (DCM) |
| %M0012 | B-RUN-S | B RUN SELECT |
| %M0003 | D-RUN | DRIVE RUN ENABLE |
| %M0017 | DXFER | START DRIVE XFER |
| %M0037 | MK-DXFR | MAKE DXFER LATCH |

```
|     #0153  OUT        %Q0015
|
|  << RUNG 44  STEP #0154 >>
|
|SPEED                                                                A TO B
|MATCH                                                                DRIVE
|LATCH                                                                XFER
|SPD-M-L                                                              A-B-D-X
|%M0049  +------+                                                     %M0018
+--] [---+ TMR +-------------------------------------------------------( )--
|        |0.10s|
|        |     |
|  CONST -+PV   |
|  +00003 |     |
|        +------+
|        A
|        DISENGA
|        GE
|        DELAY
|        A-DENGD
|        %R0010
|
|     #0154  LD         %M0049
|     #0155  FUNC 10    TMR
|                  P1:   00010
|                  P2:  +00003
|                  P3:  %R0010
|     #0156  OUT        %M0018
|
```

| REFERENCE | NICKNAME | REFERENCE DESCRIPTION |
|---|---|---|
| %M0018 | A-B-D-X | A TO B DRIVE XFER |
| %R0010 | A-DENGD | A DISENGAGE DELAY |
| %M0049 | SPD-M-L | SPEED MATCH LATCH |

```
| << RUNG 45  STEP #0157 >>
|
| A TO B                                                                  AUTO
| DRIVE                                                                   DRIVE
| XFER                                                                    SELECT
| A-B-D-X                                                                 A-D-SLT
| %M0018                                                                  %Q0030
+--] [--+-----------------------------------------------------------------( )--
|       |
| MAKE  |
| WXFER |
| LATCH |
| M-WXFRL |
| %M0046 |
+--] [--+
|       |
| %M0506 |
+--] [--+
|
|     #0157  LD        %M0018
|     #0158  OR        %M0046
|     #0159  OR        %M0506
|     #0160  OUT       %Q0030
|
| << RUNG 46  STEP #0161 >>
|
|        DRIVE
| B RUN  RUN                                                              B RUN
| SELECT ENABLE                                                           ENABLE
| B-RUN-S D-RUN                                                           B-RUN-E
| %M0012 %M0003                                                           %M0014
+--] [--+--] [--------------------------------------------------------------( )--
|       |
| MAKE  |
| DXFER |
| LATCH |
| MK-DXFR |
| %M0037 |
+--] [--+
|
|     #0161  LD        %M0012
|     #0162  OR        %M0037
|     #0163  AND       %M0003
----- IL TEXT FOR RUNG CONTINUED NEXT PAGE -----
```

| REFERENCE | NICKNAME | REFERENCE DESCRIPTION |
|---|---|---|
| %M0506 | | |
| %M0018 | A-B-D-X | A TO B DRIVE XFER |
| %Q0030 | A-D-SLT | AUTO DRIVE SELECT |
| %M0014 | B-RUN-E | B RUN ENABLE |
| %M0012 | B-RUN-S | B RUN SELECT |
| %M0003 | D-RUN | DRIVE RUN ENABLE |
| %M0046 | M-WXFRL | MAKE WXFER LATCH |
| %M0037 | MK-DXFR | MAKE DXFER LATCH |

```
|     #0164  OUT        %M0014
|
|  << RUNG 47  STEP #0165 >>
|
|                                                                    B TRAC
|B RUN    B RUN                                                      ENABLE
|ENABLE   SELECT                                                     (DCM)
|B-RUN-E  B-RUN-S                                                    B-TRACK
|%M0014   %M0012                                                     %Q0008
+--] [-----] [-----------------------------------------------------------( )--
|
|     #0165  LD         %M0014
|     #0166  AND        %M0012
|     #0167  OUT        %Q0008
|
|  << RUNG 48  STEP #0168 >>
|
|                                                                    B RUN
|B RUN                                                               ENABLE
|ENABLE                                                              (DCM)
|B-RUN-E                                                             BRUN-EN
|%M0014                                                              %Q0010
+--] [--+--------------------------------------------------------------( )--
|       |
|MAKE   |
|DXFER  |
|LATCH  |
|MK-DXFR|
|%M0037 |
+--] [--+
|
|     #0168  LD         %M0014
|     #0169  OR         %M0037
|     #0170  OUT        %Q0010
|
|  << RUNG 49  STEP #0171 >>
|
|                                                                    B PID
|B RUN    B RUN                                                      ENABLE
|ENABLE   SELECT                                                     (DCM)
|B-RUN-E  B-RUN-S                                                    BPID-EN
|%M0014   %M0012                                                     %Q0014
+--] [-----] [-----------------------------------------------------------( )--
|
|     #0171  LD         %M0014
----- IL TEXT FOR RUNG CONTINUED NEXT PAGE -----
```

| REFERENCE | NICKNAME | REFERENCE DESCRIPTION |
|---|---|---|
| %M0014 | B-RUN-E | B RUN ENABLE |
| %M0012 | B-RUN-S | B RUN SELECT |
| %Q0008 | B-TRACK | B TRACK ENABLE (DCM) |
| %Q0014 | BPID-EN | B PID ENABLE (DCM) |
| %Q0010 | BRUN-EN | B RUN ENABLE (DCM) |
| %M0037 | MK-DXFR | MAKE DXFER LATCH |

```
     #0172  AND        %M0012
     #0173  OUT        %Q0014

 << RUNG 50  STEP #0174 >>

B
UNLOAD
POS.
LIMIT
B-UN-LS
%I0013  +------+                                                    %M0060
+--] [--->UPCTR+-------------------------------------------------------( )--
|        |      |
B        |      |
UNLOAD   |      |
BUNLOAD  |      |
%M0015   |      |
+--]/[---+R     |
|        |      |
 CONST -+PV     |
 +00002 |       |
        +------+

        %R0060

     #0174  LD         %I0013
     #0175  LD    NOT  %M0015
     #0176  FUNC 15    UPCTR
                 P1:   +00002
                 P2:   %R0060
     #0177  OUT        %M0060
```

| REFERENCE | NICKNAME | REFERENCE DESCRIPTION |
|---|---|---|
| %M0060 | | |
| %R0060 | | |
| %I0013 | B-UN-LS | B UNLOAD POS. LIMIT |
| %M0015 | BUNLOAD | B UNLOAD |

```
| << RUNG 51  STEP #0178 >>
|
| B                                                                    NOT RU
| DISENGA DRIVE                                                        B
| GE &    RUN                                                          UNLOAD
| UNLOAD  ENABLE                                                       PREP
| B-DISNG  D-RUN                                                       B-PRP-U
| %I0008  %M0003  %M0060                                               %M0600
+--] [--+--]/[-----]/[-----------------------------------------------( )--
|       |
| NOT RUN|
| B      |
| UNLOAD |
| PREP   |
| B-PRP-U|
| %M0600 |
+--] [--+
|
|     #0178  LD        %I0008
|     #0179  OR        %M0600
|     #0180  AND  NOT  %M0003
|     #0181  AND  NOT  %M0060
|     #0182  OUT       %M0600
|
```

| REFERENCE | NICKNAME | REFERENCE DESCRIPTION |
|---|---|---|
| %M0060 | | |
| %I0008 | B-DISNG | B DISENGAGE & UNLOAD |
| %M0600 | B-PRP-U | NOT RUN B UNLOAD PREP |
| %M0003 | D-RUN | DRIVE RUN ENABLE |

```
<< RUNG 52  STEP #0183 >>

B
DISENGA
GE &     B RUN                                                          B
UNLOAD   ENABLE                                                         UNLOAD
B-DISNG  B-RUN-E                                                        BUNLOAD
%I0008   %M0014   %M0060                                                %M0015
+--] [--+--]/[--+--]/[-------------------------------------------------( )--
|        |
         |NOT RUN|
         |B      |
B        |UNLOAD |
UNLOAD   |PREP   |
BUNLOAD  |B-PRP-U|
%M0015   |%M0600 |
+--] [--+--] [--+
|        |
B ROLL   |
DISENGA  |
GE       |
DELAY    |
DIS-DLY  |
%M0028   |
+--] [--+
|
|     #0183  LD        %I0008
|     #0184  OR        %M0015
|     #0185  OR        %M0028
|     #0186  LD   NOT  %M0014
|     #0187  OR        %M0600
|     #0188  AND  BLK
|     #0189  AND  NOT  %M0060
|     #0190  OUT       %M0015
|
```

| REFERENCE | NICKNAME | REFERENCE DESCRIPTION |
|---|---|---|
| %M0060 | | |
| %I0008 | B-DISNG | B DISENGAGE & UNLOAD |
| %M0600 | B-PRP-U | NOT RUN B UNLOAD PREP |
| %M0014 | B-RUN-E | B RUN ENABLE |
| %M0015 | BUNLOAD | B UNLOAD |
| %M0028 | DIS-DLY | B ROLL DISENGAGE DELAY |

```
<< RUNG 53  STEP #0191 >>

                                                                    B MOVE
B                                                                   TO
UNLOAD                                                              UNLOAD
BUNLOAD                                                             B-UNLD
%M0015  +------+                                                    %Q0027
+--] [---+ TMR +-----------------------------------------------------( )--
         |0.10s|
         |     |
 CONST -+PV    |
 +00030 |      |
        +------+

        %R0330

     #0191  LD         %M0015
     #0192  FUNC 10    TMR
                P1:    00010
                P2:   +00030
                P3:   %R0330
     #0193  OUT        %Q0027

<< RUNG 54  STEP #0194 >>

                                                                    B
B                                                                   UNLOAD
UNLOAD                                                              HOIST
BUNLOAD                                                              HOIST
%M0015                                                              %Q0024
+--] [-------------------------------------------------------------( )--

     #0194  LD         %M0015
     #0195  OUT        %Q0024
```

| REFERENCE | NICKNAME | REFERENCE DESCRIPTION |
|---|---|---|
| %R0330 | | |
| %Q0027 | B-UNLD | B MOVE TO UNLOAD |
| %M0015 | BUNLOAD | B UNLOAD |
| %Q0024 | HOIST | B UNLOAD HOIST |

```
| << RUNG 55  STEP #0196 >>
|
|                                A                                                B CORE
| A DRIVE          B ROLL        RETURN                                           KEEPER
| TRANSFE B RUN     CHNG         TO PREP                                          DISENGA
| R LIMIT SELECT    LATCH        POS.                                             GE
| DXFR-LS B-RUN-S B-RC-L         A-PRP-R                                          KPR-DIS
| %I0027  %M0012  %M0027         %M0022                                           %Q0023
+--]/[-----]/[-----]/[-----]/[--+-----------------------------------------( )--
|                               |
| B PREP                        |
| LATCH                         |
| B-PRP-L                       |
| %M0502                        |
+--] [--------------------------+
|                               |
| NOT RUN                       |
| B                             |
| UNLOAD                        |
| PREP                          |
| B-PRP-U                       |
| %M0600                        |
+--] [--------------------------+
|
|      #0196  LD    NOT  %I0027
|      #0197  AND   NOT  %M0012
|      #0198  AND   NOT  %M0027
|      #0199  AND   NOT  %M0022
|      #0200  OR         %M0502
|      #0201  OR         %M0600
|      #0202  OUT        %Q0023
|
```

| REFERENCE | NICKNAME | REFERENCE DESCRIPTION |
|---|---|---|
| %M0022 | A-PRP-R | A RETURN TO PREP POS. |
| %M0502 | B-PRP-L | B PREP LATCH |
| %M0600 | B-PRP-U | NOT RUN B UNLOAD PREP |
| %M0027 | B-RC-L | B ROLL CHNG LATCH |
| %M0012 | B-RUN-S | B RUN SELECT |
| %I0027 | DXFR-LS | A DRIVE TRANSFER LIMIT |
| %Q0023 | KPR-DIS | B CORE KEEPER DISENGAGE |

```
<< RUNG 56  STEP #0203 >>

                                                                    A-B
A DRIVE DRIVE                                                       DRIVE
TRANSFE RUN                                                         SPEED
R LIMIT ENABLE                                                      MATCH
DXFR-LS  D-RUN                                                      S-MATCH
%I0027  %M0003  +------+                                            %M0019
+--] [-----] [---+ GT  |+-------------------------------------------( )--
                 | INT |
        A DIA.   |     |
        CAL.     |     |
        A-DIA-C  |     |
        %AI002 -+I1  Q+-+
                 |
         CONST -+I2    |
         +07664 +------+

     #0203  LD        %I0027
     #0204  AND       %M0003
     #0205  FUNC 57   GT
                P1:   %AI002
                P2:   +07664
     #0206  OUT       %M0019

<< RUNG 57  STEP #0207 >>

A-B
DRIVE   A DRIVE DRIVE                                               SPEED
SPEED   TRANSFE RUN                                                 MATCH
MATCH   R LIMIT ENABLE                                              LATCH
S-MATCH DXFR-LS  D-RUN                                              SPD-M-L
%M0019  %I0027  %M0003                                              %M0049
+--] [--+--] [-----] [----------------------------------------------( )--
        |
SPEED   |
MATCH   |
LATCH   |
SPD-M-L |
%M0049  |
+--] [--+

     #0207  LD        %M0019
     #0208  OR        %M0049
     #0209  AND       %I0027
----- IL TEXT FOR RUNG CONTINUED NEXT PAGE -----
```

| REFERENCE | NICKNAME | REFERENCE DESCRIPTION |
|---|---|---|
| %AI002 | A-DIA-C | A DIA. CAL. |
| %M0003 | D-RUN | DRIVE RUN ENABLE |
| %I0027 | DXFR-LS | A DRIVE TRANSFER LIMIT |
| %M0019 | S-MATCH | A-B DRIVE SPEED MATCH |
| %M0049 | SPD-M-L | SPEED MATCH LATCH |

```
|      #0210  AND        %M0003
|      #0211  OUT        %M0049

|  << RUNG 58  STEP #0212 >>

|SPEED   B ROLL
|MATCH   CHNG                                                          B DRIV
|LATCH   LATCH                                                         ENGAGE
|SPD-M-L B-RC-L                                                        B-D-EN
|%M0049  %M0027                                                        %M0020
+--] [--+--]/[-----------------------------------------------------------( )-
|       |
|B DRIVE|
|ENGAGE |
|B-D-ENG|
|%M0020 |
+--] [--+
|       |
|B RUN  |
|SELECT |
|B-RUN-S|
|%M0012 |
+--] [--+
|
|      #0212  LD         %M0049
|      #0213  OR         %M0020
|      #0214  OR         %M0012
|      #0215  AND  NOT   %M0027
|      #0216  OUT        %M0020
|
```

| REFERENCE | NICKNAME | REFERENCE DESCRIPTION |
|---|---|---|
| %M0020 | B-D-ENG | B DRIVE ENGAGE |
| %M0027 | B-RC-L | B ROLL CHNG LATCH |
| %M0012 | B-RUN-S | B RUN SELECT |
| %M0049 | SPD-M-L | SPEED MATCH LATCH |

```
| << RUNG 59  STEP #0217 >>
|
|                  B ROLL  SPEED
| B DRIVE B RUN    CHNG    MATCH                                          B DRIVE
| ENGAGE  ENABLE   LATCH   LATCH                                          ENGAGE
| B-D-ENG B-RUN-E  B-RC-L  SPD-M-L                                         B-ENG
| %M0020  %M0014   %M0027  %M0049                                         %Q0021
+--]/[-----]/[--+--]/[-----]/[--+-----------------------------------------( )--
|               |              |
| A RUN         |              |
| SELECT        |              |
| A-RUN-S       |              |
| %M0011        |              |
+--] [----------+              |
|                              |
| B PREP                       |
| LATCH                        |
| B-PRP-L                      |
| %M0502                       |
+--] [-------------------------+
|                              |
| NOT RUN                      |
| B                            |
| UNLOAD                       |
| PREP                         |
| B-PRP-U                      |
| %M0600                       |
+--] [-------------------------+
|
|     #0217  LD   NOT  %M0020
|     #0218  AND  NOT  %M0014
|     #0219  OR        %M0011
|     #0220  AND  NOT  %M0027
|     #0221  AND  NOT  %M0049
|     #0222  OR        %M0502
|     #0223  OR        %M0600
|     #0224  OUT       %Q0021
|
```

| REFERENCE | NICKNAME | REFERENCE DESCRIPTION |
|---|---|---|
| %M0011 | A-RUN-S | A RUN SELECT |
| %M0020 | B-D-ENG | B DRIVE ENGAGE |
| %Q0021 | B-ENG | B DRIVE ENGAGE |
| %M0502 | B-PRP-L | B PREP LATCH |
| %M0600 | B-PRP-U | NOT RUN B UNLOAD PREP |
| %M0027 | B-RC-L | B ROLL CHNG LATCH |
| %M0014 | B-RUN-E | B RUN ENABLE |
| %M0049 | SPD-M-L | SPEED MATCH LATCH |

```
| << RUNG 60  STEP #0225 >>
|
| MANUAL  WXFER                                                    MANUAL
| WEB     MODE    B RUN                                            WXFER
| XFER.   SELECT  ENABLE                                           LATCH
| WXFR-PB WXFR-S  B-RUN-E                                          MAN-W-X
| %I0009  %M0056  %M0014                                           %M0055
+--] [--+--] [-----] [-----------------------------------------------( )--
|       |
| MANUAL |
| WXFER  |
| LATCH  |
| MAN-W-X|
| %M0055 |
+--] [--+
|
|     #0225  LD        %I0009
|     #0226  OR        %M0055
|     #0227  AND       %M0056
|     #0228  AND       %M0014
|     #0229  OUT       %M0055
|
| << RUNG 61  STEP #0230 >>
|
| WEB                                                              WXFER
| XFER                                                             MODE
| MODE                                                             SELECT
| WXFR-MD                                                          WXFR-S
| %I0010                                                           %M0056
+--] [-------------------------------------------------------------( )-
|
|     #0230  LD        %I0010
|     #0231  OUT       %M0056
|
```

| REFERENCE | NICKNAME | REFERENCE DESCRIPTION |
|---|---|---|
| %M0014 | B-RUN-E | B RUN ENABLE |
| %M0055 | MAN-W-X | MANUAL WXFER LATCH |
| %I0010 | WXFR-MD | WEB XFER MODE |
| %I0009 | WXFR-PB | MANUAL WEB XFER. |
| %M0056 | WXFR-S | WXFER MODE SELECT |

```
<< RUNG 62  STEP #0232 >>

                                                                    START
B DRIVE                                                             WEB
ENGAGE                                                              XFER
B-D-ENG                                                             S-WXFER
%M0020  +------+                                                    %M0025
+--] [---+ GT_  |+-------------------------------------------------( )--
         | INT  ||
         |      ||
B DIA.   |      ||
CAL.     |      ||
B-DIA-C  |      ||
%AI003 -+I1  Q++
         |
 CONST -+I2    |
 +31500 +------+

     #0232  LD         %M0020
     #0233  FUNC 57    GT
                  P1:  %AI003
                  P2:  +31500
     #0234  OUT        %M0025
```

| REFERENCE | NICKNAME | REFERENCE DESCRIPTION |
|---|---|---|
| %M0020 | B-D-ENG | B DRIVE ENGAGE |
| %AI003 | B-DIA-C | B DIA. CAL. |
| %M0025 | S-WXFER | START WEB XFER |

```
<< RUNG 63  STEP #0235 >>

START   WXFER            DRIVE                                          START
WEB     MODE    A RUN    RUN                                            WXFER
XFER    SELECT  SELECT   ENABLE                                         LATCH
S-WXFER WXFR-S  A-RUN-S   D-RUN                                         S-WXFRL
%M0025  %M0056  %M0011   %M0003                                         %M0045
+--] [-----]/[--+--]/[-----] [-----------------------------------------( )--
|
|START          |
|WXFER          |
|LATCH          |
|S-WXFRL        |
|%M0045         |
+--] [----------+
|
|MANUAL         |
|WXFER          |
|LATCH          |
|MAN-W-X        |
|%M0055         |
+--] [----------+
|
|     #0235  LD        %M0025
|     #0236  AND  NOT  %M0056
|     #0237  OR        %M0045
|     #0238  OR        %M0055
|     #0239  AND  NOT  %M0011
|     #0240  AND       %M0003
|     #0241  OUT       %M0045

 << RUNG 64  STEP #0242 >>

START                                                                   WEB
WXFER                                                                   TRANSF
LATCH                                                                   R LIGH
S-WXFRL                                                                 WXFR-L
%M0045                                                                  %Q0017
+--] [-------------------------------------------------------------( )--
|
|     #0242  LD        %M0045
|     #0243  OUT       %Q0017
```

| REFERENCE | NICKNAME | REFERENCE DESCRIPTION |
|---|---|---|
| %M0011 | A-RUN-S | A RUN SELECT |
| %M0003 | D-RUN | DRIVE RUN ENABLE |
| %M0055 | MAN-W-X | MANUAL WXFER LATCH |
| %M0025 | S-WXFER | START WEB XFER |
| %M0045 | S-WXFRL | START WXFER LATCH |
| %Q0017 | WXFR-LT | WEB TRANSFER LIGHT |
| %M0056 | WXFR-S | WXFER MODE SELECT |

```
<< RUNG 65  STEP #0244 >>

START                                                                ENGAGI
WXFER                                                                WEB
LATCH                                                                TRANSFI
S-WXFRL                                                              R POS.
%M0045                                                               WXFR-PS
+--] [--+-------------------------------------------------------------%Q0019
        |                                                            ( )--
WEB     |
XFER    |
LATCH   |
WXFER-L |
%M0029  |
+--] [--+

     #0244  LD        %M0045
     #0245  OR        %M0029
     #0246  OUT       %Q0019

<< RUNG 66  STEP #0247 >>

START                                                                MAKE
WXFER                                                                WEB
LATCH                                                                XFER
S-WXFRL                                                              M-WXF
%M0045  +-----+                                                      %M0026
+--] [---+ GT_ |+-----------------------------------------------------( )--
         | INT ||
         |     ||
B DIA.   |     ||
CAL.     |     ||
B-DIA-C  |     ||
%AI003 -+I1  Q++
         |
 CONST -+I2   |
 +31900 +-----+

     #0247  LD        %M0045
     #0248  FUNC 57   GT
                P1:  %AI003
                P2:  +31900
     #0249  OUT       %M0026
```

| REFERENCE | NICKNAME | REFERENCE DESCRIPTION |
|---|---|---|
| %AI003 | B-DIA-C | B DIA. CAL. |
| %M0026 | M-WXFER | MAKE WEB XFER |
| %M0045 | S-WXFRL | START WXFER LATCH |
| %M0029 | WXFER-L | WEB XFER LATCH |
| %Q0019 | WXFR-PS | ENGAGE WEB TRANSFER POS. |

```
| << RUNG 67  STEP #0250 >>
|
| MAKE     PASTE            DRIVE                                                MAKE
| WEB      CUT      A RUN   RUN                                                  WXFER
| XFER     DELAY    SELECT  ENABLE                                               LATCH
| M-WXFER  P-C-DLY  A-RUN-S  D-RUN                                               M-WXFRL
| %M0026   %M0057   %M0011  %M0003                                               %M0046
+--] [-----]/[--+--]/[-----] [-----------------------------------------------( )--
|               |
| MAKE          |
| WXFER         |
| LATCH         |
| M-WXFRL       |
| %M0046        |
+--] [----------+
|               |
| PASTE         |
| CUT           |
| DELAY         |
| P-C-DLY       |
| %M0057        |
+--] [----------+
|
|      #0250  LD        %M0026
|      #0251  AND  NOT  %M0057
|      #0252  OR        %M0046
|      #0253  OR        %M0057
|      #0254  AND  NOT  %M0011
|      #0255  AND       %M0003
|      #0256  OUT       %M0046
|
```

| REFERENCE | NICKNAME | REFERENCE DESCRIPTION |
|---|---|---|
| %M0011 | A-RUN-S | A RUN SELECT |
| %M0003 | D-RUN | DRIVE RUN ENABLE |
| %M0026 | M-WXFER | MAKE WEB XFER |
| %M0046 | M-WXFRL | MAKE WXFER LATCH |
| %M0057 | P-C-DLY | PASTE CUT DELAY |

```
<< RUNG 68  STEP #0257 >>

MAKE                                                                HOIST
WXFER                                                               WARNIN(
LATCH                                                               LIGHT
M-WXFRL                                                             HOIST-I
%M0046                                                              %Q0033
+--] [--+-------------------------------------------------------------( )--
        |
B       |
UNLOAD  |
BUNLOAD |
%M0015  |
+--] [--+

     #0257  LD        %M0046
     #0258  OR        %M0015
     #0259  OUT       %Q0033

<< RUNG 69  STEP #0260 >>

MANUAL                                                              PASTE
WXFER                                                               CUT
LATCH                                                               DELAY
MAN-W-X                                                             P-C-DL
%M0055  +-----+                                                     %M0057
+--] [---+ TMR +-----------------------------------------------------( )--
         |0.10s|
         |     |
 CONST -+PV    |
 +00050 |      |
        +-----+

        MANUAL
        CUT
        DELAY
        MAN-CUT
        %R0040

     #0260  LD        %M0055
     #0261  FUNC 10   TMR
                P1:   00010
                P2:  +00050
                P3:  %R0040
     #0262  OUT       %M0057
```

| REFERENCE | NICKNAME | REFERENCE DESCRIPTION |
|---|---|---|
| %M0015 | BUNLOAD | B UNLOAD |
| %Q0033 | HOIST-L | HOIST WARNING LIGHT |
| %M0046 | M-WXFRL | MAKE WXFER LATCH |
| %R0040 | MAN-CUT | MANUAL CUT DELAY |
| %M0055 | MAN-W-X | MANUAL WXFER LATCH |
| %M0057 | P-C-DLY | PASTE CUT DELAY |

```
| << RUNG 70  STEP #0263 >>
|
|        B ROLL
| MAKE   DISENGA                                                    B ROLL
| WXFER  GE                                                         CHNG
| LATCH  DELAY                                                      LATCH
| M-WXFRL DIS-DLY                                                   B-RC-L
| %M0046 %M0028                                                     %M0027
+--] [--+--]/[-----------------------------------------------------------( )--
|       |
| B ROLL |
| CHNG   |
| LATCH  |
| B-RC-L |
| %M0027 |
+--] [--+
|
|     #0263  LD        %M0046
|     #0264  OR        %M0027
|     #0265  AND  NOT  %M0028
|     #0266  OUT       %M0027
|
```

| REFERENCE | NICKNAME | REFERENCE DESCRIPTION |
|---|---|---|
| %M0027 | B-RC-L | B ROLL CHNG LATCH |
| %M0028 | DIS-DLY | B ROLL DISENGAGE DELAY |
| %M0046 | M-WXFRL | MAKE WXFER LATCH |

```
<< RUNG 71  STEP #0267 >>

NIP ROL
LER RES
ET (LAY LAY-ON
-ON)    ROLLER
NIP-RST LAY-ON
%I0030  %I0032          +------+                                        %M0310
+--] [-----] [--+--------+ TMR +-----------------------------------------( )--
|               |        |0.10s|
|               |        |     |
|       NIP     |        |     |
LAY-ON  SOLENOI |        |     |
ROLLER  D       |        |     |
LAY-ON    NIP   |        |     |
%I0032  %Q0020  |        |     |
+--]/[-----] [--+ CONST -+PV   |
                  +00030 |     |
                         +------+

                         %R0310

     #0267  LD        %I0030
     #0268  AND       %I0032
     #0269  LD   NOT  %I0032
     #0270  AND       %Q0020
     #0271  OR   BLK
     #0272  FUNC 10   TMR
                 P1:   00010
                 P2:  +00030
                 P3:  %R0310
     #0273  OUT       %M0310
```

| REFERENCE | NICKNAME | REFERENCE DESCRIPTION |
|---|---|---|
| %M0310 | | |
| %R0310 | | |
| %I0032 | LAY-ON | LAY-ON ROLLER |
| %Q0020 | NIP | NIP SOLENOID |
| %I0030 | NIP-RST | NIP ROLLER RESET (LAY-ON) |

```
<< RUNG 72  STEP #0274 >>

B ROLL                                                                  WEB
CHNG                                                                    XFER
LATCH                                                                   LATCH
B-RC-L                                                                  WXFER-
%M0027  %M0310                                                          %M00
+--] [--+--]/[-------------------------------------------------------( )-
        |
WEB     |
XFER    |
LATCH   |
WXFER-L |
%M0029  |
+--] [--+

     #0274  LD        %M0027
     #0275  OR        %M0029
     #0276  AND  NOT  %M0310
     #0277  OUT       %M0029

<< RUNG 73  STEP #0278 >>

WEB                                                                     NIP
XFER                                                                    SOLENO
LATCH                                                                   D
WXFER-L                                                                   NIP
%M0029                                                                  %Q0020
+--] [-----------------------------------------------------------------( )-

     #0278  LD        %M0029
     #0279  OUT       %Q0020

<< RUNG 74  STEP #0280 >>

%M0070                                                                  %Q0034
+--] [-----------------------------------------------------------------( )-

     #0280  LD        %M0070
     #0281  OUT       %Q0034
```

| REFERENCE | NICKNAME | REFERENCE DESCRIPTION |
|---|---|---|
| %Q0034 | | |
| %M0070 | | |
| %M0310 | | |
| %M0027 | B-RC-L | B ROLL CHNG LATCH |
| %Q0020 | NIP | NIP SOLENOID |
| %M0029 | WXFER-L | WEB XFER LATCH |

```
<< RUNG 75  STEP #0282 >>

WEB                                                                    CUT
XFER                                                                   SOLENOI
LATCH                                                                  D
WXFER-L                                                                  CUT
%M0029  %M0070                                                         %Q0004
+--] [-----]/[-------------------------------------------------------------( )--

     #0282  LD         %M0029
     #0283  AND  NOT   %M0070
     #0284  OUT        %Q0004

<< RUNG 76  STEP #0285 >>

WEB
XFER
LATCH
WXFER-L
%M0029  +------+                                                       %M007?
+--] [---+ TMR +-------------------------------------------------------------( )
         |0.10s|
         |     |
 CONST -+PV    |
 +00010 |      |
        +------+

        %R0110

     #0285  LD         %M0029
     #0286  FUNC 10    TMR
                  P1:   00010
                  P2:  +00010
                  P3:  %R0110
     #0287  OUT        %M0070
```

| REFERENCE | NICKNAME | REFERENCE DESCRIPTION |
|---|---|---|
| %M0070 | | |
| %R0110 | | |
| %Q0004 | CUT | CUT SOLENOID |
| %M0029 | WXFER-L | WEB XFER LATCH |

```
<< RUNG 77  STEP #0288 >>

                                                                    B ROLL
B ROLL                                                              DISENGA
CHNG                                                                GE
LATCH                                                               DELAY
B-RC-L                                                              DIS-DLY
%M0027  +------+                                                    %M0028
+--] [---+ TMR +-------------------------------------------------------( )--
         |0.10s|
         |     |
 CONST -+PV    |
 +00010 |      |
        +------+
        B
        DISENGA
        GE
        DELAY
        B-DENGD
        %R0030

    #0288  LD         %M0027
    #0289  FUNC 10    TMR
                 P1:   00010
                 P2:  +00010
                 P3:  %R0030
    #0290  OUT        %M0028

<< RUNG 78  STEP #0291 >>

B ROLL  NIP ROL                                                     DISENG:
DISENGA LER RES                                                     GE
GE      ET (LAY                                                     LAY-ON
DELAY   -ON)                                                        ROLLER
DIS-DLY NIP-RST                                                     DIS-LAY
%M0028  %I0030                                                      %M0030
+--] [--+--]/[-------------------------------------------------------( )--
        |
DISENGA|
GE     |
LAY-ON |
ROLLER |
DIS-LAY|
%M0030 |
+--] [--+
|
----- IL TEXT FOR RUNG CONTINUED NEXT PAGE -----
```

| REFERENCE | NICKNAME | REFERENCE DESCRIPTION |
|---|---|---|
| %R0030 | B-DENGD | B DISENGAGE DELAY |
| %M0027 | B-RC-L | B ROLL CHNG LATCH |
| %M0028 | DIS-DLY | B ROLL DISENGAGE DELAY |
| %M0030 | DIS-LAY | DISENGAGE LAY-ON ROLLER |
| %I0030 | NIP-RST | NIP ROLLER RESET (LAY-ON) |

```
|      #0291  LD        %M0028
|      #0292  OR        %M0030
|      #0293  AND  NOT  %I0030
|      #0294  OUT       %M0030

|  << RUNG 79  STEP #0295 >>

|IDLE
|RUN
| IDLE
|%I0024                                                          %M0050
+--] [-----------------------------------------------------------( )--
|
|      #0295  LD        %I0024
|      #0296  OUT       %M0050

|  << RUNG 80  STEP #0297 >>

|                                                                IDLE
|                                                                RUN
|                                                                IDLE-
|%M0050                                                          %Q0032
+--] [-----------------------------------------------------------( )--
|
|      #0297  LD        %M0050
|      #0298  OUT       %Q0032

|  << RUNG 81  STEP #0299 >>

|%M0050  +------+
+--] [---+MOVE_+-
|        | INT |
|        |     |
|        |     |  TENSION
|TENSION |     |  REFEREN
|SETPOIN |     |  CE TO D
|T       |     |  ANCER I
|TEN-SET |     |  TEN-REF
|%AI001 -+IN  Q+-%AQ001
|        | LEN |
|        |00001|
|        |     |
|        +------+

|      #0299  LD        %M0050
|      #0300  FUNC 37   MOVIN
----- IL TEXT FOR RUNG CONTINUED NEXT PAGE -----
```

| REFERENCE | NICKNAME | REFERENCE DESCRIPTION |
|---|---|---|
| %M0050 | | |
| %I0024 | IDLE | IDLE RUN |
| %Q0032 | IDLE-R | IDLE RUN |
| %AQ001 | TEN-REF | TENSION REFERENCE TO DANCER I/P |
| %AI001 | TEN-SET | TENSION SETPOINT |

```
|                 P1:  %AI001
|                 P2:  +00001
|                 P3:  %AQ001

 << RUNG 82  STEP #0301 >>

|%M0050  +------+
+--] [---+MOVE_+-
|        | INT |
|        |     |
|        |     | TENSION
| TENSION|     | REFEREN
| SETPOIN|     | CE TO
| T      |     | METER
| TEN-SET|     | TEN-RFM
| %AI001 -+IN  Q+-%AQ002
|        | LEN |
|        |00001|
|        |     |
|        +------+

     #0301  LD          %M0050
     #0302  FUNC 37     MOVIN
                P1:    %AI001
                P2:    +00001
                P3:    %AQ002

 << RUNG 83  STEP #0303 >>

|%M0050  +------+
+--]/[---+MOVE_+-
|        | INT |
|        |     |
|        |     | TENSION
|        |     | REFEREN
|        |     | CE TO D
|        |     | ANCER I
|        |     | TEN-REF
| CONST -+IN  Q+-%AQ001
| +05500 | LEN |
|        |00001|
|        |     |
|        +------+

     #0303  LD   NOT    %M0050
     #0304  FUNC 37     MOVIN
                P1:    +05500
----- IL TEXT FOR RUNG CONTINUED NEXT PAGE -----
```

| REFERENCE | NICKNAME | REFERENCE DESCRIPTION |
|---|---|---|
| %M0050 | | |
| %AQ001 | TEN-REF | TENSION REFERENCE TO DANCER I/P |
| %AQ002 | TEN-RFM | TENSION REFERENCE TO METER |
| %AI001 | TEN-SET | TENSION SETPOINT |

```
|                 P2:  +00001
|                 P3:  %AQ001

| << RUNG 84  STEP #0305 >>

|%M0050  +-----+
+--]/[---+MOVE_+-
|         | INT |
|         |     |
|         |     | TENSION
|         |     | REFEREN
|         |     | CE TO
|         |     | METER
|         |     | TEN-RFM
| CONST -+IN  Q+-%AQ002
| +05500 | LEN |
|        |00001|
|        |     |
|        +-----+

|     #0305  LD   NOT  %M0050
|     #0306  FUNC 37   MOVIN
|                P1:  +05500
|                P2:  +00001
|                P3:  %AQ002

|[      END OF PROGRAM LOGIC      ]

|     #0307  END OF PROGRAM
|
```

| REFERENCE NICKNAME | | REFERENCE DESCRIPTION |
|---|---|---|
| %M0050 | | |
| %AQ002 | TEN-RFM | TENSION REFERENCE TO METER |

The preferred embodiment of the present invention has now been described. This preferred embodiment constitutes the best mode contemplated by the inventors for carrying out their invention. Because the invention may be copied without copying the precise details of the preferred embodiment, the following claims particularly point out and distinctly claim the subject matter which the inventors regard as their invention and wish to protect:

We claim:

1. An improved method of winding a running web of material, where the running web is initially being wound onto and about the center core shaft of a first roll; where after the first roll has had a determined amount of web would thereon, the running web is to be spliced and thereafter is to be wound, after splicing, onto and about a center core shaft of a second roll; and where the running web is running at a preselected speed while the running web is being wound about the first roll, while the running web is being spliced, and while the running web is being wound about the second roll, the improved method comprising the steps of:

driving the first roll, through a fixed drive assembly, while the first roll is disposed in an operating position so that the running web runs at the preselected speed;

disposing the central core shaft of the second roll in a splicing position, which is adjacent to the operating position of the first roll;

running the running web so that it passes adjacent to the center core shaft of the second roll before it is wound onto the first roll;

driving the center core shaft of the second roll, while the center core shaft of the second roll is in its splicing position, through a movable drive assembly so that the surface speed of the center core shaft of the second roll matches the predetermined speed of the running web;

pressing an adjacent portion of the running web into surface to surface contact with the outer peripheral surface of the center core shaft of the second roll such that the portion will adhere to the outer peripheral surface of the center core shaft of the second roll;

cutting the running web downstream of the adjacent portion of the running web so that the running web will then begin to wind about the center core shaft of the second roll;

disconnecting the first roll from the fixed drive assembly;

moving the first roll from the operating position; and moving the second roll, and the movable drive assembly, along a substantial straight path, from the splicing position to the operating position.

2. The improved running web winding method of claim 1 in which the first and second rolls, in their operating and splicing positions, respectively, are adjacent to each other and are disposed side by side.

3. The improved running web winding method of claim 2 in which the second roll is moved generally horizontally from the splicing position to the operating position.

4. The improved running web winding method of claim 1 which includes the steps of connecting the fixed drive assembly with the second roll after the second roll has been moved from the splicing position to the operating position.

5. The improved running web winding method of claim 4 which includes the steps of disconnecting the movable drive assembly from the second roll after the fixed drive assembly has been connected with the second roll and after the second roll has been moved; and moving the movable drive assembly back to a position where it may be connected with another roll's center core shaft that is thereafter disposed in the splicing position.

6. The improved running web winding method of claim 5 which includes them step of moving the movable drive assembly along a substantially horizontal path.

7. The improved running web winding method of claim 6 which includes the step of moving the second roll and movable drive assembly in a direction substantially parallel with the direction of the path of travel of the moving web.

8. The improved running web winding method of claim 7 in which the first and second rolls, in their operating and splicing positions, respectively, are adjacent to each other and are disposed side by side.

9. An improved flying paster core winding apparatus for winding a running web of material, where the running web is initially being wound onto the center core shaft of a first roll; where after the first roll has had a determined amount of web wound thereon, the running web is to be spliced and thereafter is to be wound about the center core shaft of a second roll; and where the running web is run at a preselected speed while the running web is being wound about the first roll, while the running web is being spliced and while the running web is being wound about the second roll, the improved apparatus including:

means for disposing the first roll in an operating position;

a fixed drive assembly for driving the center core shaft of the first roll, when disposed in its operating position, so that the running web runs onto and about the first roll at the preselected speed;

means for disposing the central core shaft of the second roll in a splicing position, which is adjacent to the operating position of the first roll;

an assembly for causing the running web to run so that a portion of it passes adjacent to the center core shaft of the second roll before it is wound onto and about the first roll;

a movable drive assembly for driving the center core shaft of the second roll, while the center core shaft of the second roll is in its splicing position, so that the surface speed of the center core shaft of the second roll matches the preselected speed of the running web;

an assembly for pressing an adjacent portion of the running web into surface to surface contact with the outer peripheral surface of the center core shaft of the second roll such that the portion will adhere to the outer peripheral surface of the center core shaft of the second roll when it is pressed against the center core shaft;

an assembly for cutting the running web, downstream of the adjacent portion of the running web, so that the running web will then begin to wind about the center core shaft of the second roll;

means for disconnecting the center core shaft of the first roll from the fixed drive assembly means;

means for moving the first roll from its operating position; and an assembly for moving the second roll, and the movable drive means, along a substantially straight line path, from the splicing position to the operating position.

10. The improved core winding apparatus of claim 9 which includes a device for connecting the fixed drive assembly with the center core shaft of the second roll after the second roll has been moved from the splicing position to the operating position.

11. The improved core winding apparatus of claim 10 which includes means for disconnecting the movable drive assembly from the center core shaft of the second roll after the fixed drive assembly has been connected with the center core shaft of the second roll; and which also includes an assembly for moving the movable drive assembly back to a position where it may be connected with another roll's center core shaft that is then disposed in the splicing position.

12. The improved core winding apparatus of claim 11 wherein the assembly for moving the movable drive assembly moves the movable drive assembly along a substantially horizontal path that is substantially parallel the direction of the path of travel of the moving web.

13. The improved core winding apparatus of claim 12 which includes an assembly for lifting the first roll from the apparatus after the first roll has been moved from the operating position.

14. The improved core winding apparatus of claim 9 which includes an assembly for lifting the first roll from the apparatus after the first roll has been moved from the operating position.

* * * * *